US010161364B2

(12) United States Patent
Shurdim

(10) Patent No.: US 10,161,364 B2
(45) Date of Patent: Dec. 25, 2018

(54) HOLLOW INTAKE MANIFOLD

(71) Applicant: Oliver Matt Shurdim, Anaheim, CA (US)

(72) Inventor: Oliver Matt Shurdim, Anaheim, CA (US)

( * ) Notice: Subject to any disclaimer, the term of this patent is extended or adjusted under 35 U.S.C. 154(b) by 0 days.

(21) Appl. No.: 15/688,798

(22) Filed: Aug. 28, 2017

(65) Prior Publication Data

US 2018/0171945 A1 Jun. 21, 2018

Related U.S. Application Data

(63) Continuation-in-part of application No. 15/382,512, filed on Dec. 16, 2016.

(51) Int. Cl.

| | |
|---|---|
| ***F02M 35/00*** | (2006.01) |
| ***F02M 35/10*** | (2006.01) |
| ***F02M 35/104*** | (2006.01) |

(52) U.S. Cl.

CPC .... *F02M 35/10052* (2013.01); *F02M 35/104* (2013.01); *F02M 35/10078* (2013.01); *F02M 35/10354* (2013.01)

(58) Field of Classification Search

CPC ..... F02M 35/104; F02M 35/10354; F02M 35/10222

See application file for complete search history.

(56) References Cited

PUBLICATIONS

Lubeowner. (Aug. 31, 2012, Ported Intake Manifolds [Video file], Retrieved from https://youtu.be/O6vPRQyxlzl.*

Diesel Dr. (The PowerStroke Doctor. (Jan. 7, 2015). 6.0 Ported Intake Manifold. Retrieved from https://web.archive.org/web/20150107235039/http://www.powerstrokedoctor.com/store/intake-manifold.*

ODAWG714 (Oct. 9, 2012). DIY Ported Intake. Retrieved from http://www.powerstroke.org/forum/6-0I-performance-parts-discussion/270419-diy-ported-intake-6.html.* brscott38, "Custom Intake Manifold", http://www.powerstroke.org/forum/6-0I-performance-parts-discussion/377746-custom-intake-manifold.html, Mar. 28, 2013.*

* cited by examiner

*Primary Examiner* — Kevin A Lathers

(74) *Attorney, Agent, or Firm* — Cionca IP Law P.C.; Marin Cionca

(57) ABSTRACT

An intake manifold for an internal combustion engine having at least one runner having a top end, a bottom end, a front side, and a back side defining a hollow interior space wherein the top end has a first height greater than a second height of the bottom end, and a port for receiving air into the hollow interior space, the back side having cylinder holes aligning with cylinder head openings of the internal combustion engine and bolt holes for receiving bolts, each bolt having a bolt head and a bolt thread, the front side having access holes aligning with the bolt holes, such that the intake manifold can be secured to the internal combustion engine with no portion of the bolt thread lying within the hollow interior space of the intake manifold thus preventing obstruction of air circulation through the hollow interior space.

19 Claims, 44 Drawing Sheets

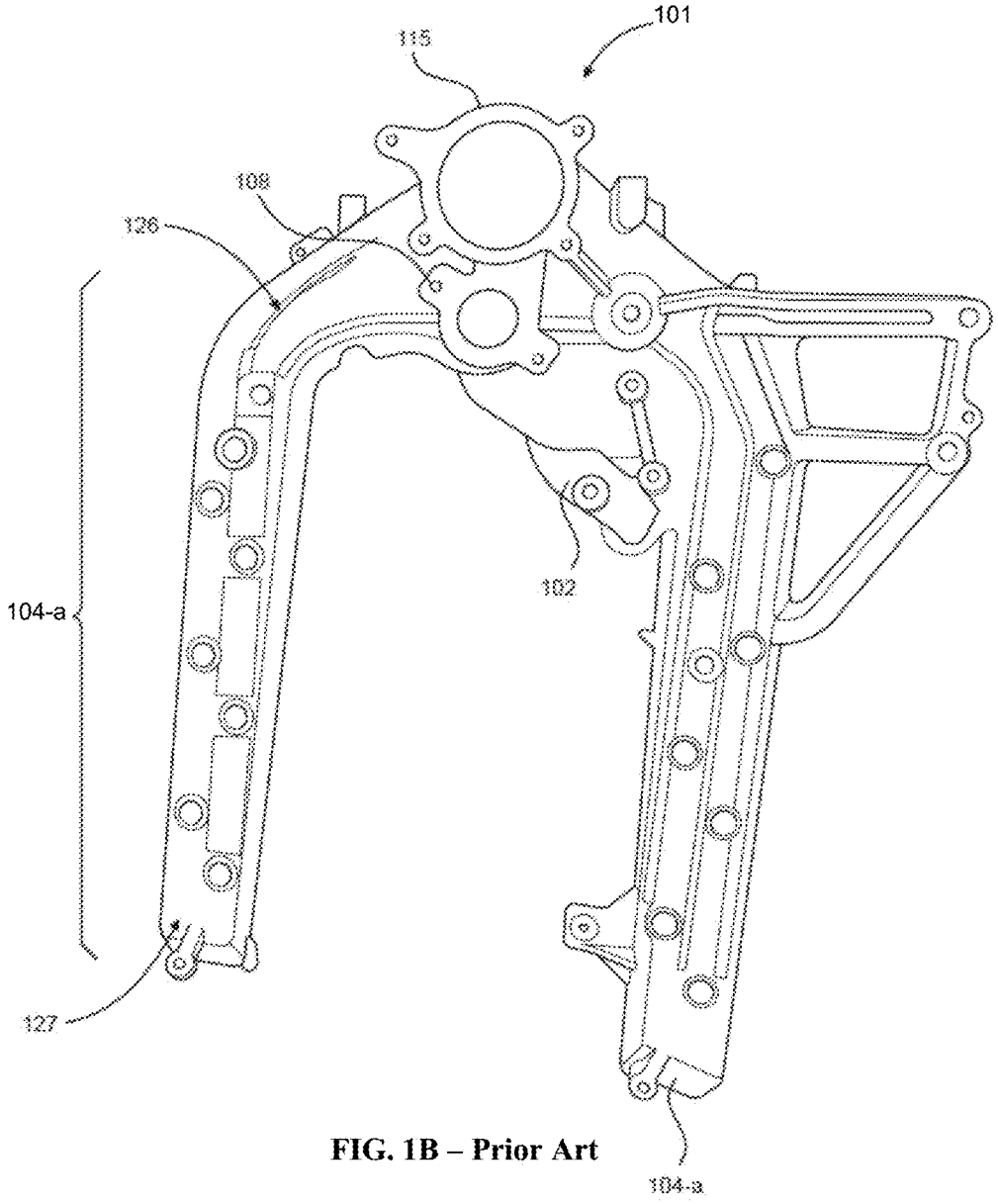
FIG. 1B – Prior Art

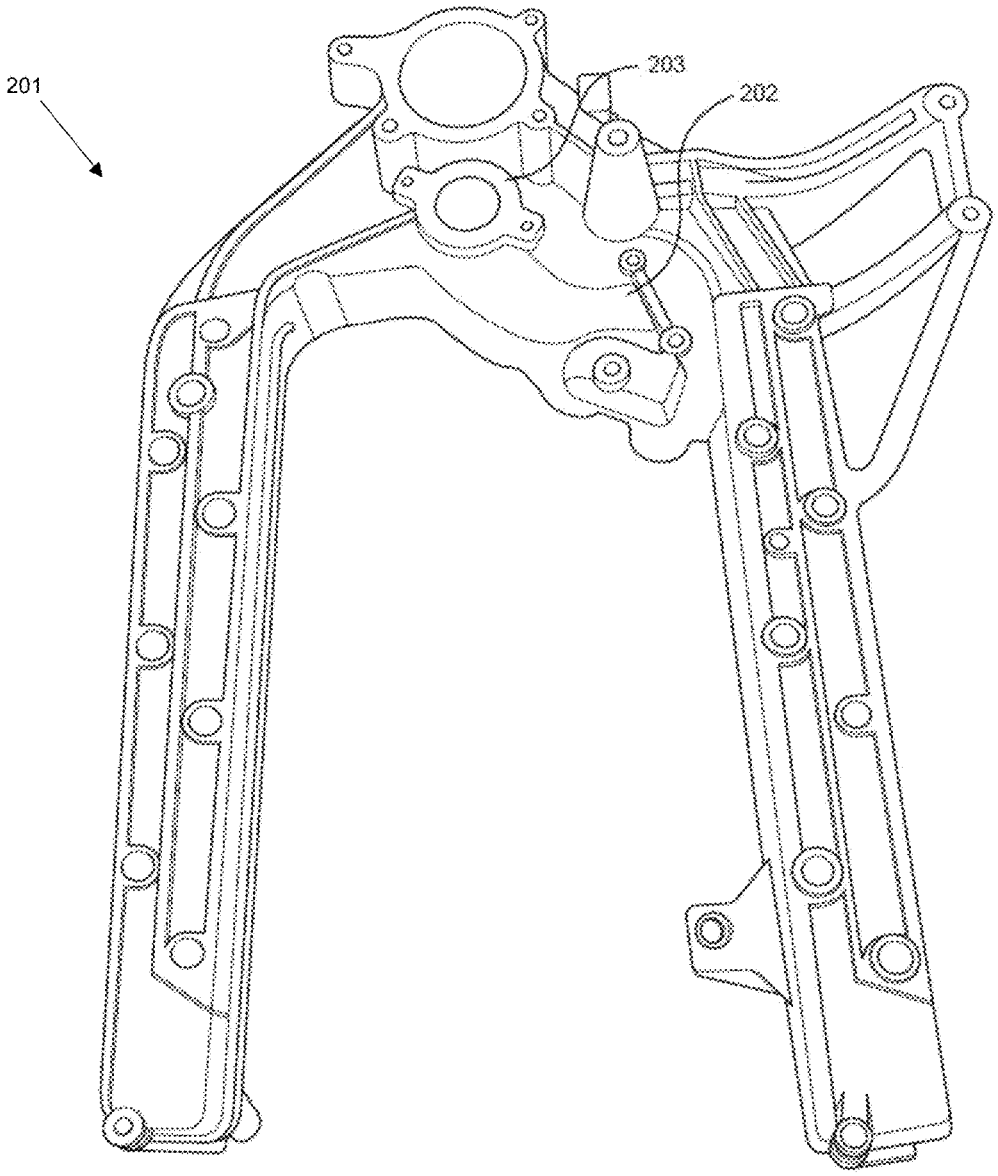
FIG. 2A – Prior Art

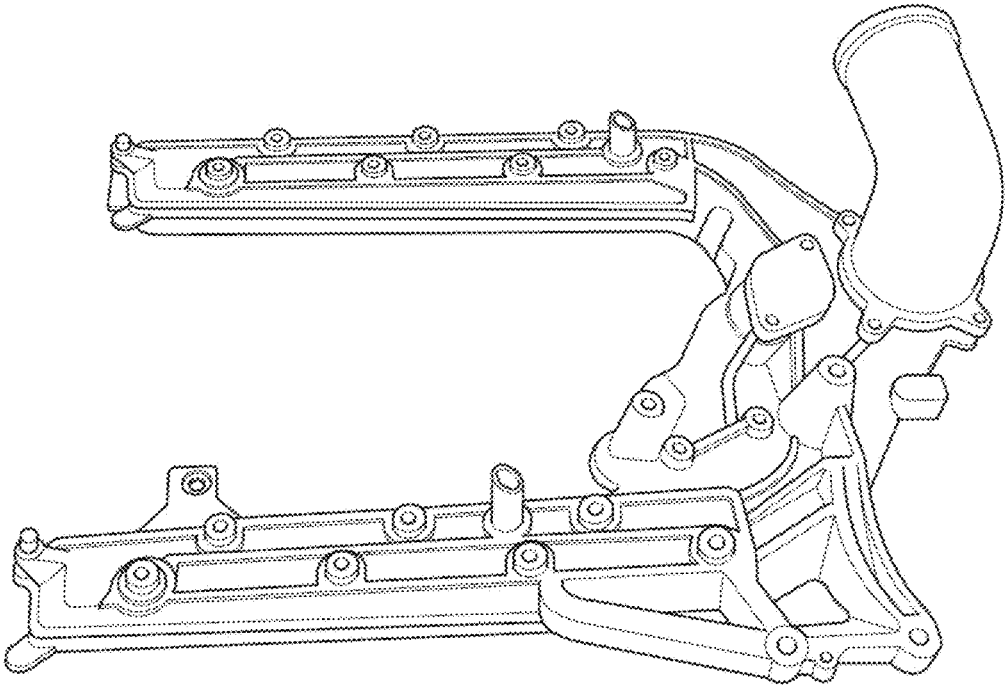
FIG. 2B – Prior Art

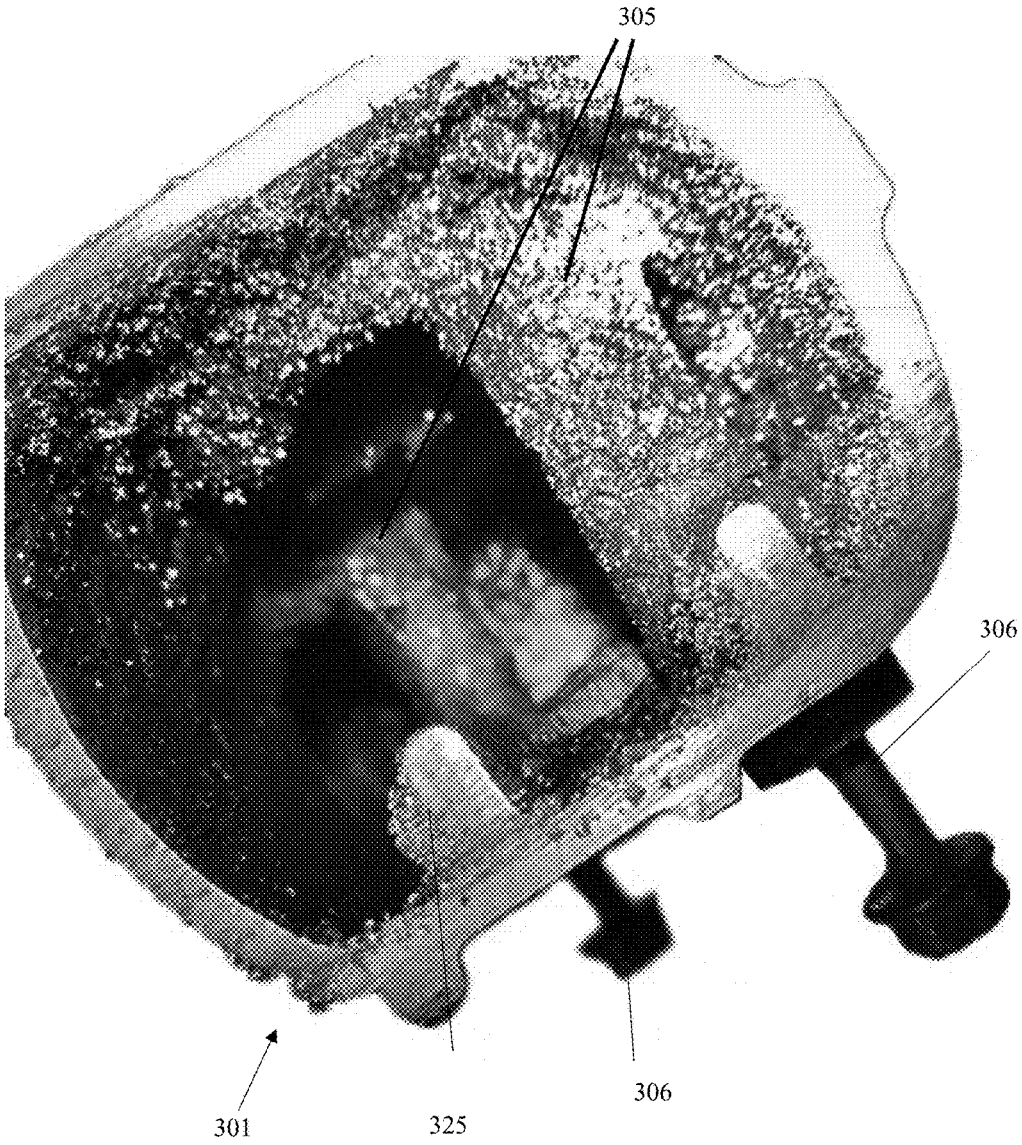
FIG. 3A – Prior Art

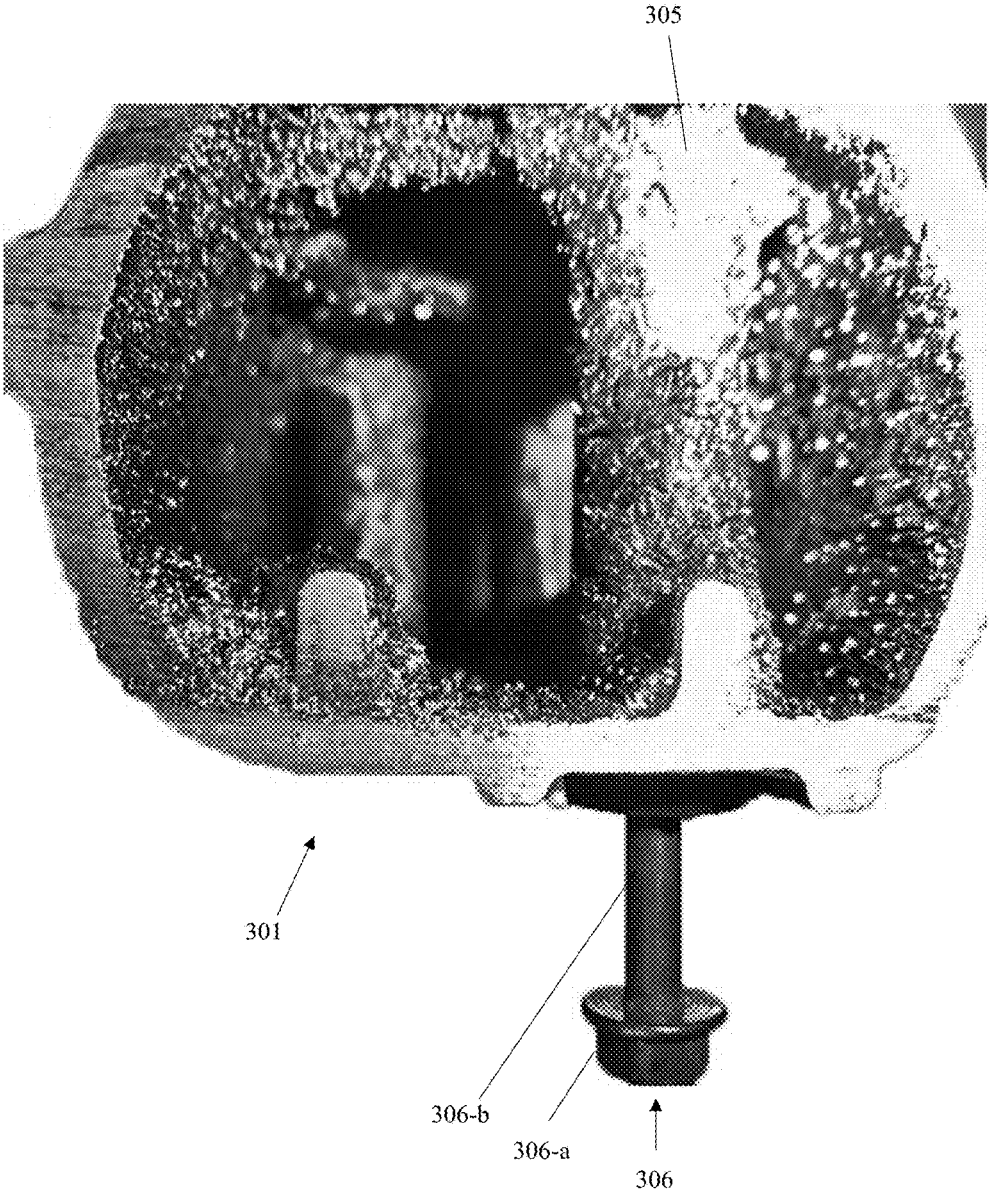
FIG. 3B – Prior Art

2100

| Computer Flow Calibration @ 25" Water | |
|---|---|
| *Theoretical Values (+/- 1 CFM)* | |
| *Flow Range(#)* | *Flow (CFM)* |
| *1 ( Bung in)* | *7* |
| *4 (Bung out)* | *240* |
| Test Values | |
| *Flow Range (#)* | *Flow (CFM)* |
| 1 (Bung in) | 7.1 |
| 4 (Bung out) | 239.7 |

| Percentage Flow Calibration @ 25" Water | |
|---|---|
| *Theoretical Values (%)* | |
| *Flow Direction* | *Percentage Flow* |
| *Intake* | *81%* |
| *Exhaust* | *75%* |
| Test Values | |
| *Flow Direction* | *Percentage Flow* |
| Intake | 80.5% |
| Exhaust | 75% |

Stock Intake Manifold

| Test Pressure: 10" of Water | | | | |
|---|---|---|---|---|
| Cylinder Port | Flow (CFM) | Restriction Pressure ("H2O) | Orifice Range | Percent Flow |
| #1 | 107 | 6.94 | 2 | 96 |
| #2 | 100 | 6.5 | 2 | 96 |
| #3 | 107 | 5.73 | 2 | 96 |
| #4 | 120 | 4.3 | 2 | 96 |
| #5 | 117 | 4.75 | 2 | 96 |
| #6 | 106 | 5.82 | 2 | 96 |
| #7 | 98 | 6.74 | 2 | 96 |
| #8 | 92 | 7.49 | 2 | 96 |
| Total Flow (All Port Open) | 295 | 9.95 | 4 | 91 |

| Test Pressure: 25" of Water | | | | |
|---|---|---|---|---|
| Cylinder Port | Flow (CFM) | Restriction Pressure ("H2O) | Orifice Range | Percent Flow |
| #1 | 158 | 22.28 | 3 | 90 |
| #2 | 168 | 20.85 | 3 | 90 |
| #3 | 173 | 18.45 | 3 | 90 |
| #4 | 198 | 13.81 | 3 | 90 |
| #5 | 185 | 15.98 | 3 | 90 |
| #6 | 168 | 19.65 | 3 | 90 |
| #7 | 156 | 22.7 | 3 | 90 |
| #8 | 150 | 24.29 | 3 | 90 |
| Total Flow (All Port Open) | 468 | 24.94 | 6 | 73 |

| Test Pressure: 28" of Water | | | | |
|---|---|---|---|---|
| Cylinder Port | Flow (CFM) | Restriction Pressure ("H2O) | Orifice Range | Percent Flow |
| #1 | 167 | 25.21 | 3 | 96 |
| #2 | 172 | 23.94 | 3 | 96 |
| #3 | 184 | 20.75 | 3 | 96 |
| #4 | 215 | 15.35 | 3 | 96 |
| #5 | 197 | 18.2 | 3 | 96 |
| #6 | 178 | 22.21 | 3 | 96 |
| #7 | 164 | 26.11 | 3 | 96 |
| #8 | 158 | 27.89 | 3 | 96 |
| Total Flow (All Port Open) | 490 | 25.25 | 6 | 74 |

| Max Test Pressure (36" of Water) | | | | |
|---|---|---|---|---|
| Total Flow (All Port Open) | 490 | 25.25 | 6 | 74 |

FIG. 24A

Stage 3 Intake Manifold

| Test Pressure: 10" of Water | | | | |
|---|---|---|---|---|
| Cylinder Port | Flow (CFM) | Restriction Pressure ("H2O) | Orifice Range | Percent Flow |
| #1 | 138 | 9.44 | 3 | 79 |
| #2 | 139 | 9.89 | 3 | 79 |
| #3 | 139 | 9.97 | 3 | 79 |
| #4 | 136 | 9.18 | 3 | 79 |
| #5 | 139 | 9.85 | 3 | 79 |
| #6 | 134 | 9.53 | 3 | 79 |
| #7 | 131 | 9.93 | 3 | 79 |
| #8 | 136 | 9.94 | 3 | 79 |
| Total Flow (All Port Open) | 348 | 7.3 | 4 | 91 |

| Test Pressure: 25" of Water | | | | |
|---|---|---|---|---|
| Cylinder Port | Flow (CFM) | Restriction Pressure ("H2O) | Orifice Range | Percent Flow |
| #1 | 213 | 23.36 | 4 | 63 |
| #2 | 202 | 24.93 | 4 | 63 |
| #3 | 205 | 24.98 | 4 | 63 |
| #4 | 214 | 22.55 | 4 | 63 |
| #5 | 218 | 21.75 | 4 | 63 |
| #6 | 216 | 23.07 | 4 | 63 |
| #7 | 209 | 24.93 | 4 | 63 |
| #8 | 212 | 24.96 | 4 | 63 |
| Total Flow (All Port Open) | 581 | 16.13 | 6 | 73 |

| Test Pressure: 28" of Water | | | | |
|---|---|---|---|---|
| Cylinder Port | Flow (CFM) | Restriction Pressure ("H2O) | Orifice Range | Percent Flow |
| #1 | 224 | 27 | 4 | 67 |
| #2 | 213 | 27.95 | 4 | 67 |
| #3 | 215 | 27.96 | 4 | 67 |
| #4 | 224 | 26.25 | 4 | 67 |
| #5 | 230 | 24.7 | 4 | 67 |
| #6 | 218 | 27.97 | 4 | 67 |
| #7 | 215 | 27.95 | 4 | 67 |
| #8 | 225 | 27.94 | 4 | 67 |
| Total Flow (All Port Open) | 619 | 16.54 | 6 | 74 |

| Max Test Pressure (36" of Water) | | | | |
|---|---|---|---|---|
| Total Flow (All Port Open) | 714 | 18.13 | 6 | 74 |

FIG. 24B

Results

| | Stock Manifold | Stage 3 Manifold |
|---|---|---|
| Highest Full Flow Test Result (36" Water) [CFM] | 490 | 714 |
| Largest Flow Difference Between Ports @10" Water [CFM] | 31.9 | 9 |
| Largest Flow Difference Between Ports @10" Water [%] | 26% | 7% |
| Largest Flow Difference Between Ports @25" Water [CFM] | 50.8 | 15.7 |
| Largest Flow Difference Between Ports @25" Water [%] | 25% | 7% |
| Largest Flow Difference Between Ports @28" Water [CFM] | 57.1 | 18.8 |
| Largest Flow Difference Between Ports @28" Water [%] | 27% | 8% |
| Flow Difference Between Front and Back Ports @ 10" Water [CFM] | 25.9 | 2.4 |
| Flow Difference Between Front and Back Ports @ 10" Water [%] | 22% | 2% |
| Flow Difference Between Front and Back Ports @ 25" Water [CFM] | 39.05 | 3.9 |
| Flow Difference Between Front and Back Ports @ 25" Water [%] | 20% | 2% |
| Flow Difference Between Front and Back Ports @ 28" Water [CFM] | 43.5 | 3.6 |
| Flow Difference Between Front and Back Ports @ 28" Water [%] | 21% | 2% |

Conclusion

| | |
|---|---|
| Increase in Flow | 46% |
| Increase in Air Distribution | 18% |

FIG. 27

HOLLOW INTAKE MANIFOLD

CROSS-REFERENCE TO RELATED APPLICATIONS

This application is a continuation-in-part of and claims the benefit of U.S. Non-Provisional application Ser. No. 15/382,512, filed Dec. 16, 2016, which is hereby incorporated by reference, to the extent that it is not conflicting with the present application.

BACKGROUND OF INVENTION

1. Field of the Invention

The invention relates generally to engines and more specifically to the intake manifold of a vehicle engine.

2. Description of the Related Art

The intake manifold of a vehicle internal combustion engine is used to supply a mixture of fuel and air evenly to the engine cylinder heads. One of various methods of improving the engine power and performance is to improve air flow. During combustion, as a piston moves down, air resistance can cause loss of power. Poor engine performance can occur due to choking of air, high exhaust gas temperatures, or poor air flow. The prior art includes intake manifolds with pillars in the interior of the hollow manifold through which bolts can pass, for securing the manifold to the cylinders, which may lead to some obstruction of air. The prior art also includes intake manifolds with exhaust gas recirculation components for recirculation of some of the engine exhaust gas back to the cylinders. The placement of these components may be at least partially inside of the intake manifold, which also cause some obstruction of air on the interior of the manifold. These designs of such intake manifolds create more air resistance and thus, poor engine performance. Therefore, there is a need for an intake manifold with improved air flow, for better performance and efficiency of the vehicle's engine.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect an intake manifold is provided in which interior pillars are removed and connected to the intake manifold on the exterior of the part only. Thus, an advantage is a larger inner volume for air flow, which may allow for better engine efficiency, and better cooling of the exhaust.

In another aspect, the exhaust gas recirculation (EGR) components are not provided with the hollow intake manifold. Thus, an advantage is that more air volume is allowed inside of the hollow intake manifold, which may allow for a cleaner and more efficiently running vehicle.

In another aspect, a hollow intake manifold is provided, having exhaust gas recirculation components. Thus, an advantage is that the intake manifold may make use of the EGR recirculation while removing some obstructions from the interior of the manifold, and result in some improvement in engine performance.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which:

FIGS. 1A-1B illustrate the front view of a hollow intake manifold, and an intake manifold as known in the art, respectively, according to an aspect.

FIGS. 2A-2B show a front view and a front perspective view, respectively, of an intake manifold as known in the art, according to an aspect.

FIGS. 3A-3B show two examples of sectional views of an intake manifold as known in the art, according to an aspect.

FIGS. 24A-24B are tables summarizing the results of a flow test for a stock intake manifold and a stage 3 intake manifold, respectively.

FIG. 27 is a chart summarizing the results and conclusions of the flow tests performed for the stock intake manifold and the stage 3 intake manifold.

DETAILED DESCRIPTION

Figure 1A:
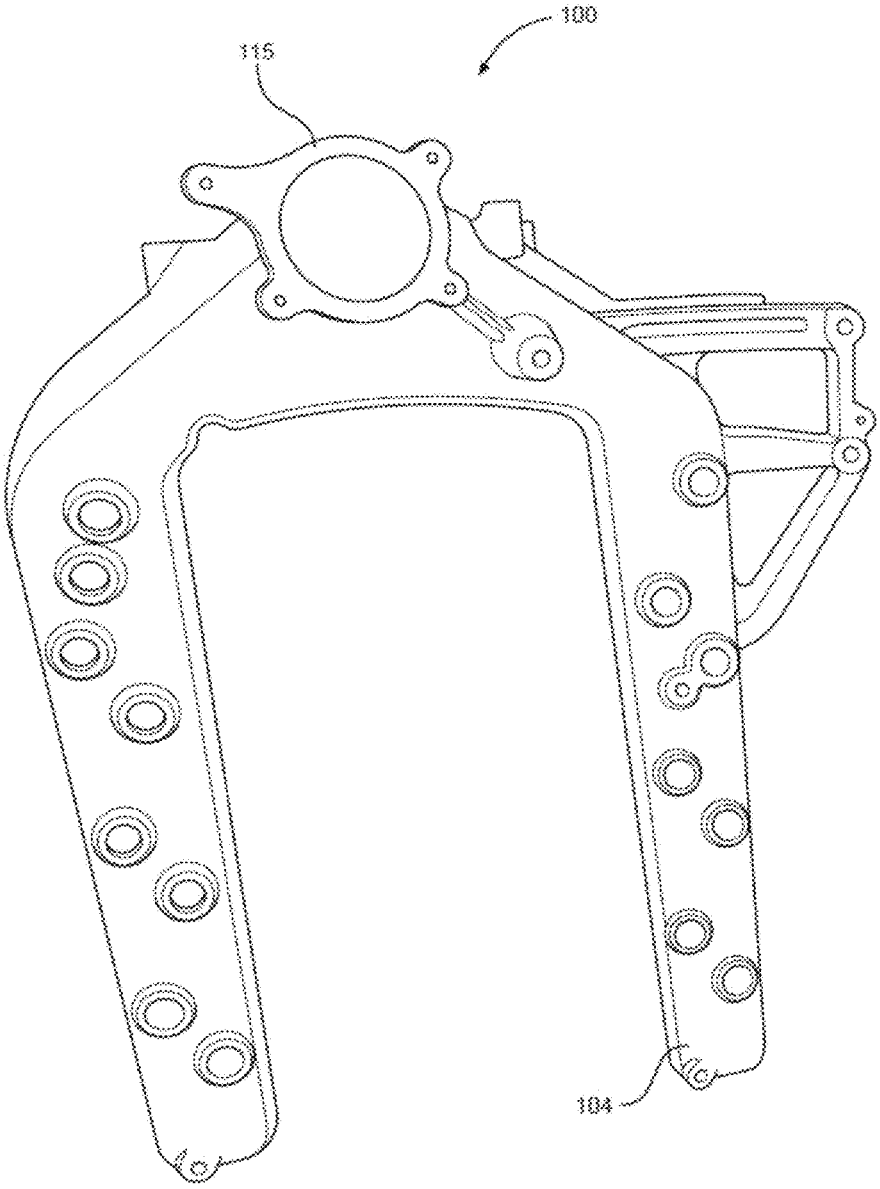

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

For the following description, it can be assumed that most correspondingly labeled elements across the figures (e.g., 100 and 400, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIGS. 1A-1B illustrate the front view of a hollow intake manifold 100, and an intake manifold 101 as known in the art ("intake manifold," or "stock intake manifold"), respectively, according to an aspect. A hollow intake manifold 100 may be provided with exhaust gas recirculation (EGR) components ("EGR components" or "smog components"), as shown by 102 in the stock intake manifold, removed. A hollow intake manifold 100 may be provided with a larger interior volume than that of an intake manifold 101 known in the art, and may have larger runners 104 ("runner," "inlet runner," or "intake runner") than the runners 104-*a* of the stock intake manifold. The hollow intake manifold 100 may lack an EGR valve (as shown by 108) below the air intake valve 115. The hollow intake manifold 100 may be used for a diesel engine, for example.

FIGS. 2A-2B show a front view and a front perspective view, respectively, of an intake manifold as known in the art, according to an aspect. The intake manifold 201 shows another example of a known intake manifold having EGR components 202, and an EGR valve 202. The EGR components may also partially be carried in the interior of the intake manifold, which may cause obstruction of air flow. An intake manifold such as the examples shown may also include inserts welded in to allow the intake manifold to be sealed, to prevent air leaks. FIG. 2*a* shows an intake manifold with EGR components still attached, and with the welded inserts, according to an aspect. FIG. 2*b* shows an intake manifold with welded inserts, at the top of the manifold, for use with a plug having an O-ring as a seal, according to an aspect. The hollow intake manifold may be used with similar diesel engines that the stock intake manifold may be used with, such as the following examples: 2003-2007 Ford 6.0 L Power Stroke engines (also provided by International and known as a VT 365 engine), the Ford 6.4 L Power Stroke engine, and 2008-2010 Ford 6.0 L Power Stroke engines. The hollow intake manifold may also be used for any other suitable diesel engine or any other suitable engine.

FIGS. 3A-3B show two examples of sectional views of a stock intake manifold 301 as known in the art, such as, for example, the stock intake manifolds shown in FIGS. 2A-2B, according to an aspect. The intake manifold 301 may have metal posts 305 ("post," or "pillar") on the interior running from end to end, which allow a bolt to be tightened without putting excess force on the top of the manifold. Through use, an intake manifold 301 may have buildup of debris and grime on the interior. The stock intake manifold may also include at least one rib 325 running along the interior of the manifold. The presence of the posts 305 and ribs 325 may lead to obstruction of air inside of the intake manifold, and the buildup of grime on the posts 305 may lead to further obstruction of air. Removal of posts 305 may be difficult, and full removal of the ribs 325 may not be possible for the user attempting to modify ("port") their stock intake manifold. The posts 305 may be mostly solid, with a hole for receiving a bolt 306, and may go all the way through the interior of the manifold. The bolt 306 may allow the manifold to attach to the vehicle's cylinder heads. The bolt 306 may have a bolt head 306-*a*, and a bolt thread 306-*b*. To secure a stock intake manifold to an internal combustion engine, a bolt 306 having a long bolt thread 305-*b* may be needed, to pass through the pillar 305.

Figure 4:
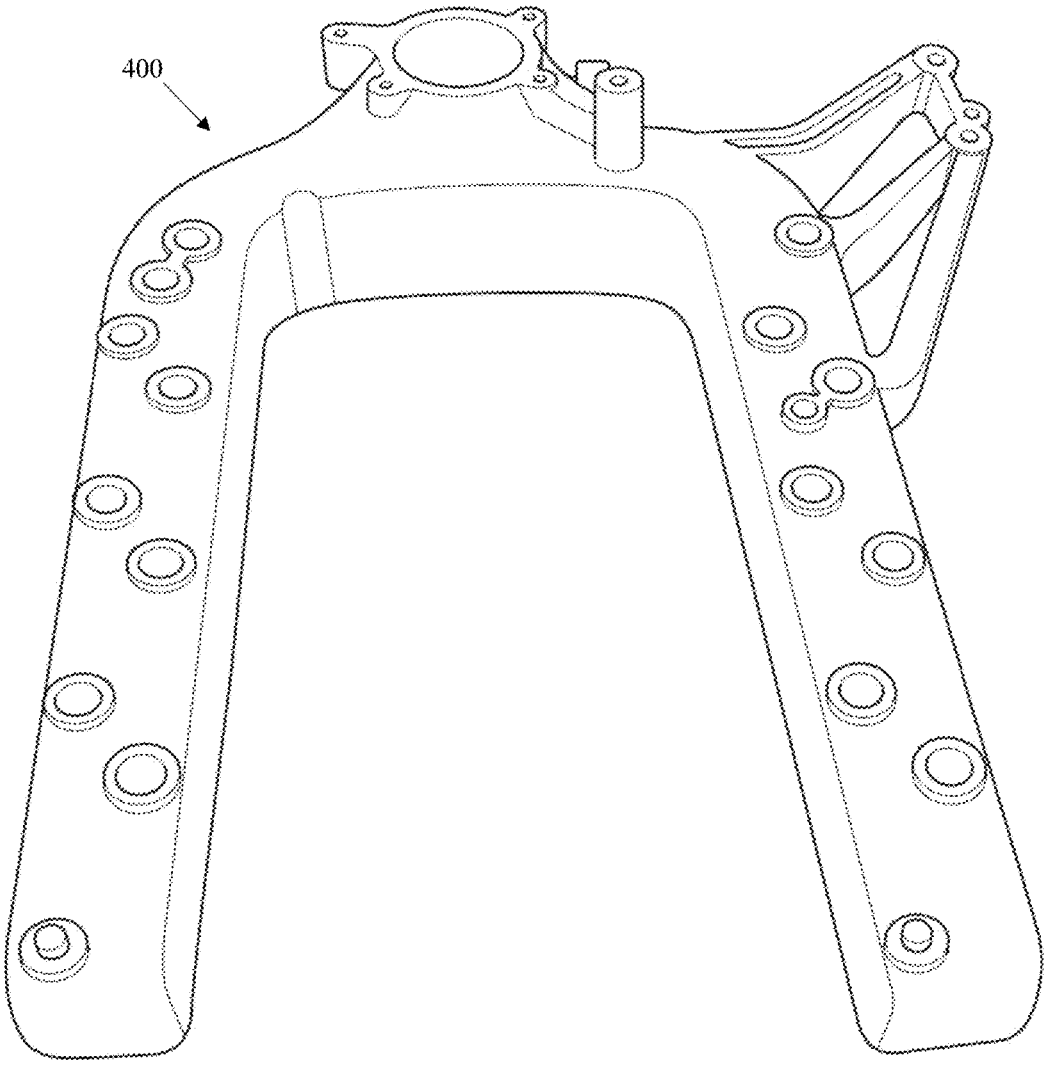
FIG. 4 shows a front perspective view of a hollow intake manifold, according to an aspect.

FIG. 4 shows a front perspective view of a hollow intake manifold 400, according to an aspect. The hollow intake manifold 400 may be provided without EGR components, and the internal volume of the hollow intake manifold may be larger than that of an intake manifold known in the art, having EGR components. A hollow intake manifold without pillars, ribs, or posts in the interior, larger than a stock intake manifold, and having EGR components may also be provided. The hollow intake manifold may also be a similar size to a stock intake manifold, and may include EGR components. The hollow intake manifold may be bolted to the cylinder by bolts as shown as shown. In an intake manifold known in the art, there may be bolts running from the front surface of the intake manifold into the cylinder head, which may cause obstruction of air.

Figure 5A:
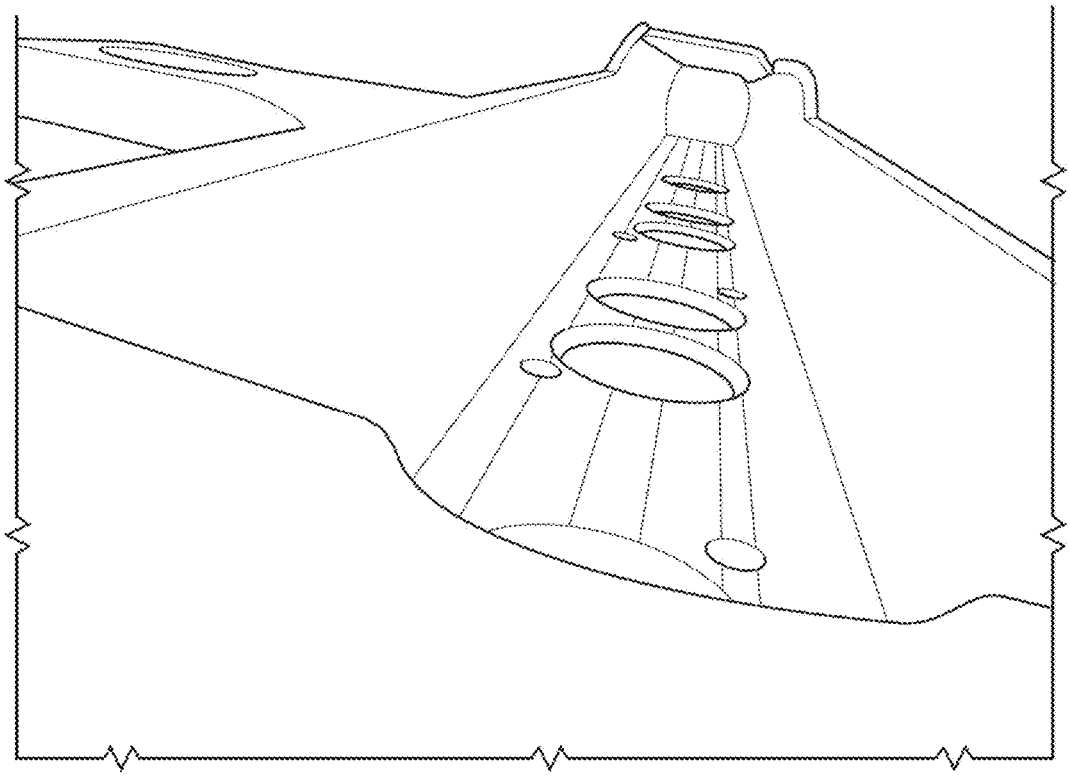
FIGS. 5A-5B show a perspective sectional view and a sectional view, respectively, of a hollow intake manifold, according to an aspect.
Figure 5B:
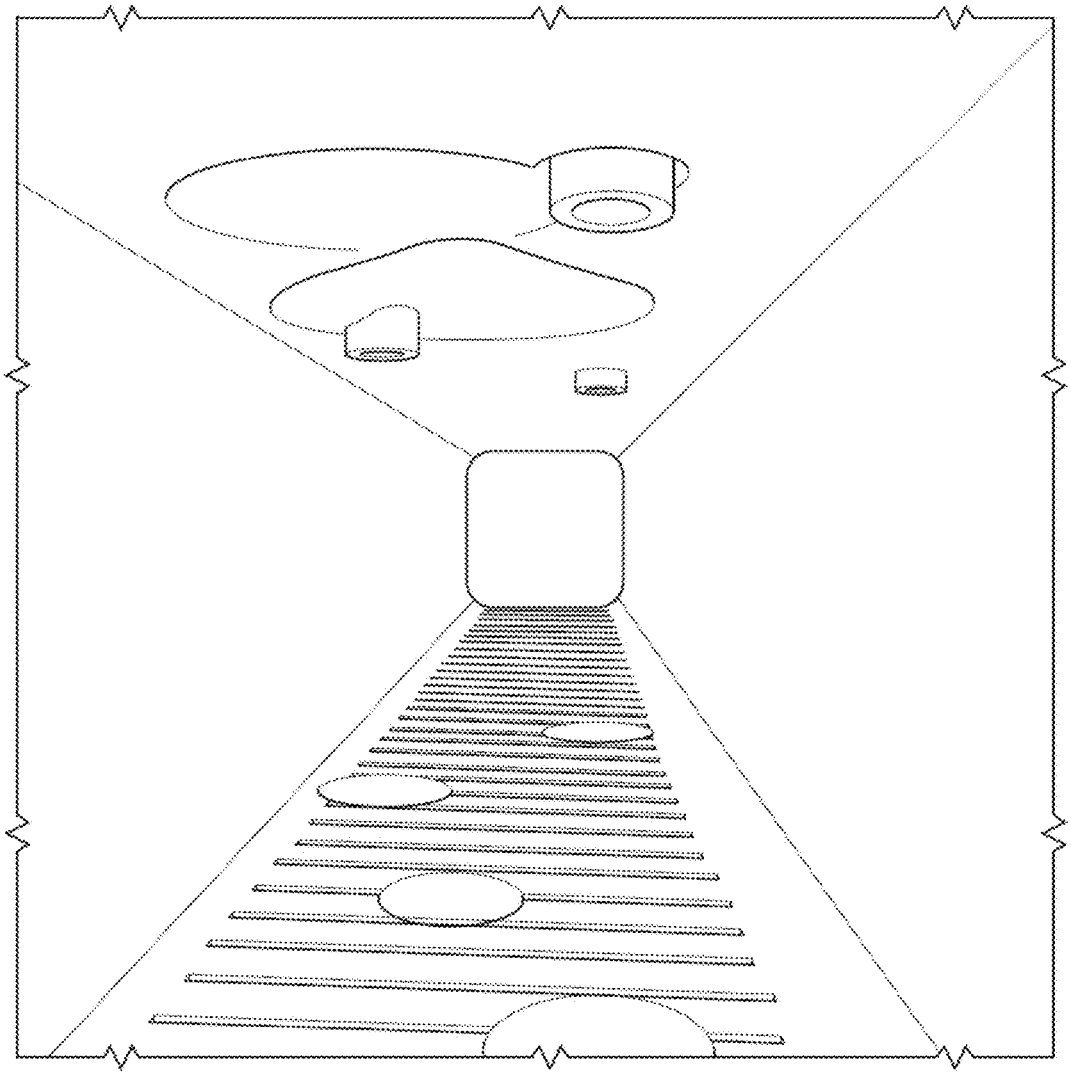

FIGS. 5A-5B show a perspective sectional view and a sectional view, respectively, of a hollow intake manifold, according to an aspect. FIG. 5A shows a stock intake manifold known in the art that may be modified to be hollow, by removal of the interior posts, according to an aspect. The posts, which obstructed the interior of the intake manifold known in the art (shown in FIGS. 3A-3B) may be removed from the interior of the hollow intake manifold manually, and the modified intake manifold may then be used for better engine performance. FIG. 5B shows another example of an intake manifold, a hollow intake manifold that may be custom built without interior bolts, according to an aspect. The bolts may be recessed or may be flush with the interior of the hollow intake manifold. Removal of the posts from the interior of the hollow intake manifold may allow for more free-flowing air throughout the inside of the manifold.

Figure 5C:
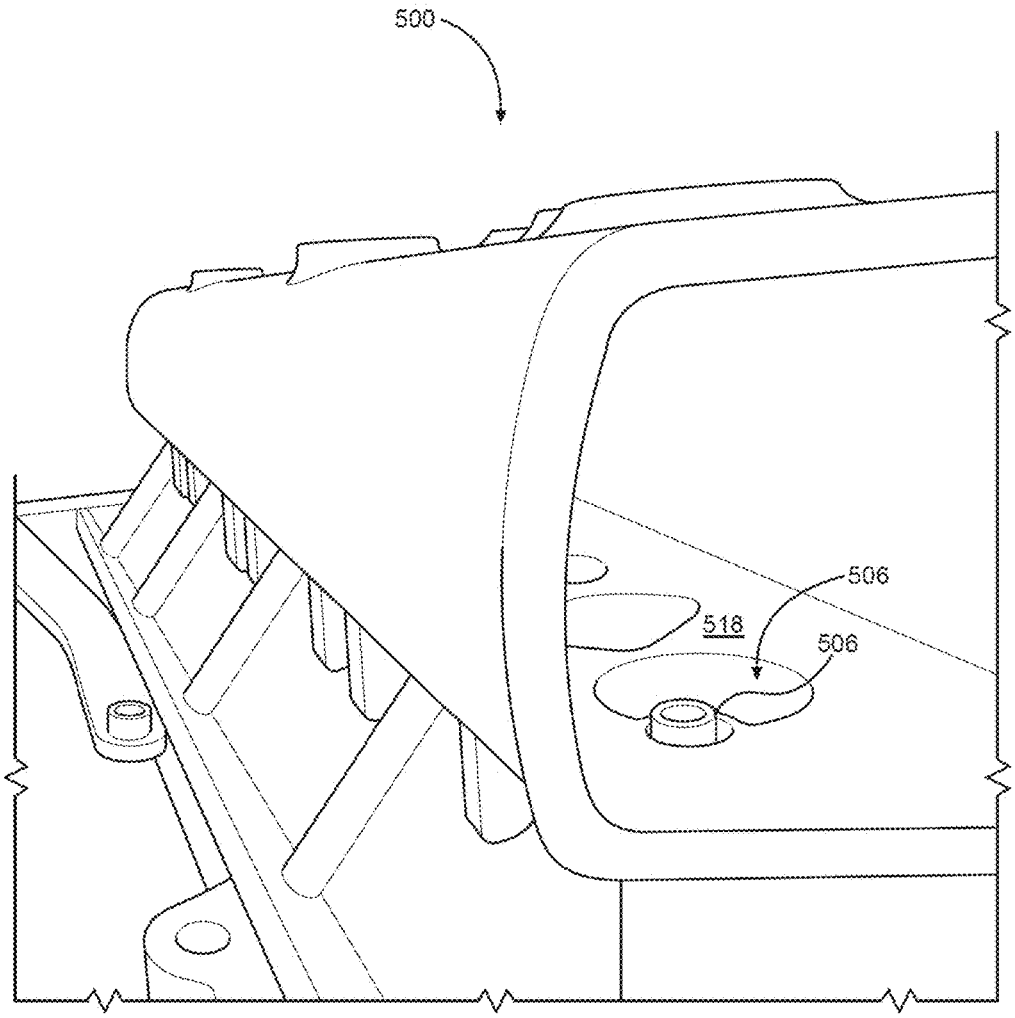
FIGS. 5C-5D show a perspective view and a detailed view, respectively, of a hollow intake manifold with its runner cut open, displaying the interior, according to an aspect.
Figure 5D:
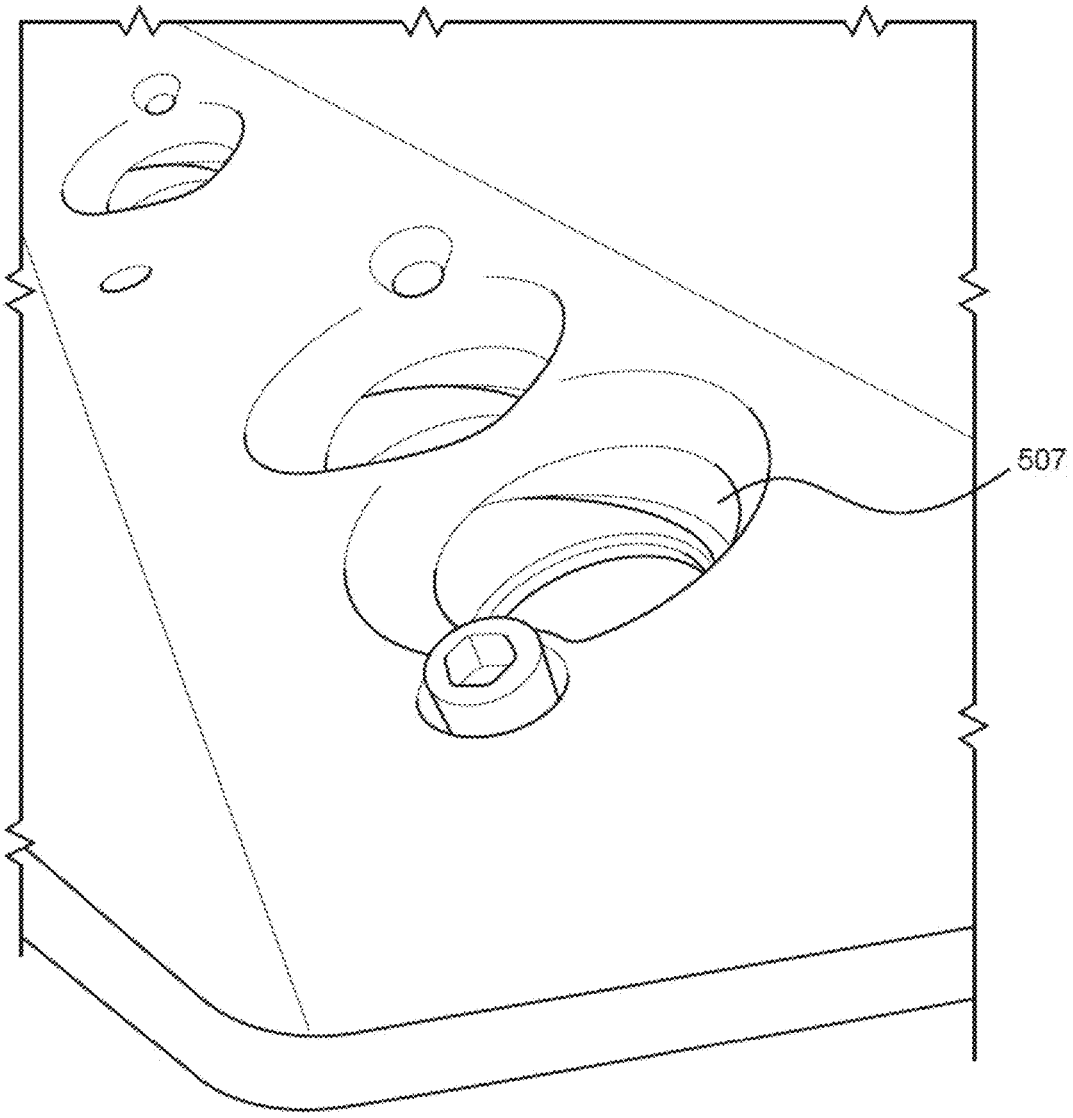

FIGS. 5C-5D show a perspective view and a detailed view, respectively, of a hollow intake manifold 500 with its runner cut open, displaying the interior, according to an aspect. Without pillars or posts, the intake manifold 500 is provided with a hollow interior space. To secure the intake manifold to the engine, the hollow intake manifold 500 may be bolted. Once bolted, the head 506-*a* of the bolt may rest on the inner floor 518 of the intake manifold such that no portion of the bolt thread is laying within the hollow interior space. As another example, the bolt may secure the intake manifold to the engine such that the bolt head 506-*a* is flush with the floor of the hollow interior space. A shorter bolt having a short bolt thread may be used for a hollow intake manifold than is needed for bolting a stock intake manifold. The inner floor of the hollow intake manifold may include cylinder head holes 507 for circulating the air/fuel mixture to the cylinder heads below.

Figure 5E:
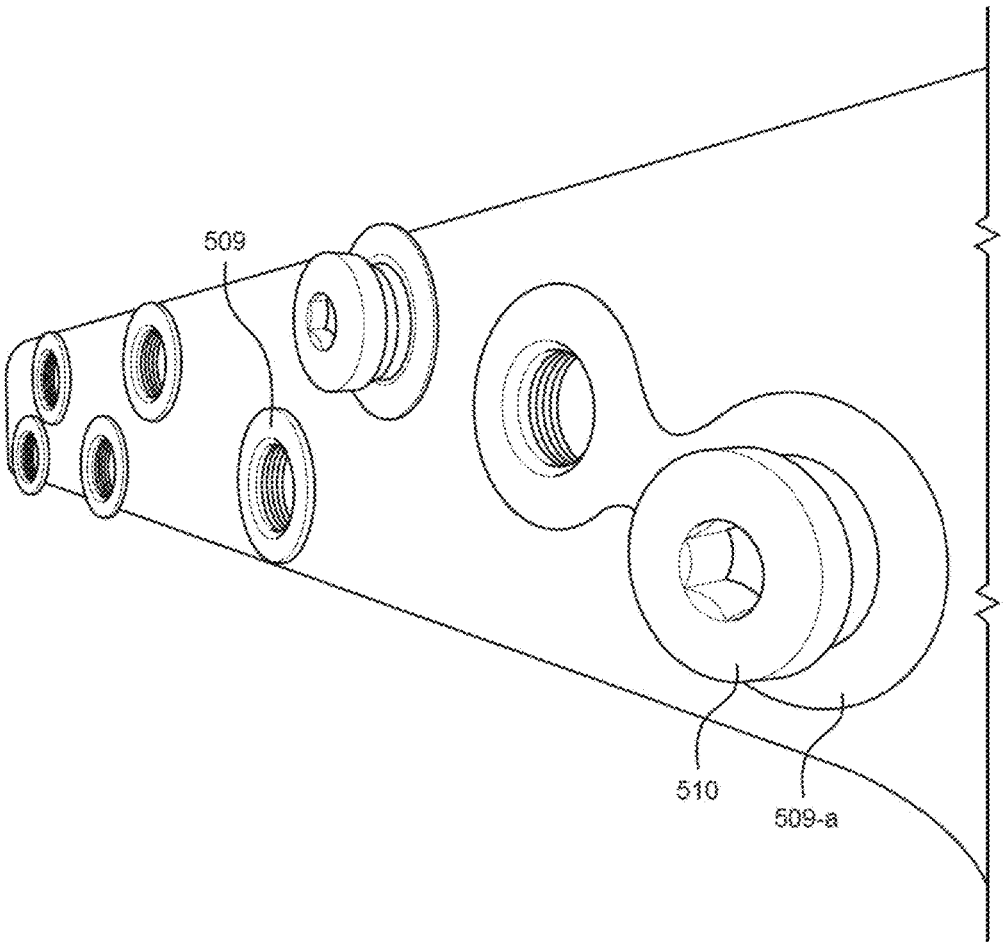
FIG. 5E shows a detailed front perspective view of one of the hollow intake manifold's runners, according to an aspect.

FIG. 5E shows a detailed front perspective view of one of the hollow intake manifold's runners, according to an aspect. The front of the hollow intake manifold may include a plurality of access holes ("access holes" or "ports") 509, such that a user may reach in with a tool for securing a bolt in the inner floor of the hollow intake manifold, using any suitable bolt-securing tool. Then, before use, the access holes may be sealed to prevent air leaks by any suitable means. As an example, the access holes may be plugged using a Society of Automotive Engineers (SAE) standard O-ring 510, such as an SAE #8 O-ring boss seal/plug. The access holes 509 may therefore include threading, as an example, for receiving a threaded seal. Access hole 509-*a* is shown sealed, and access hole 509 is shown unsealed.

Figure 6:
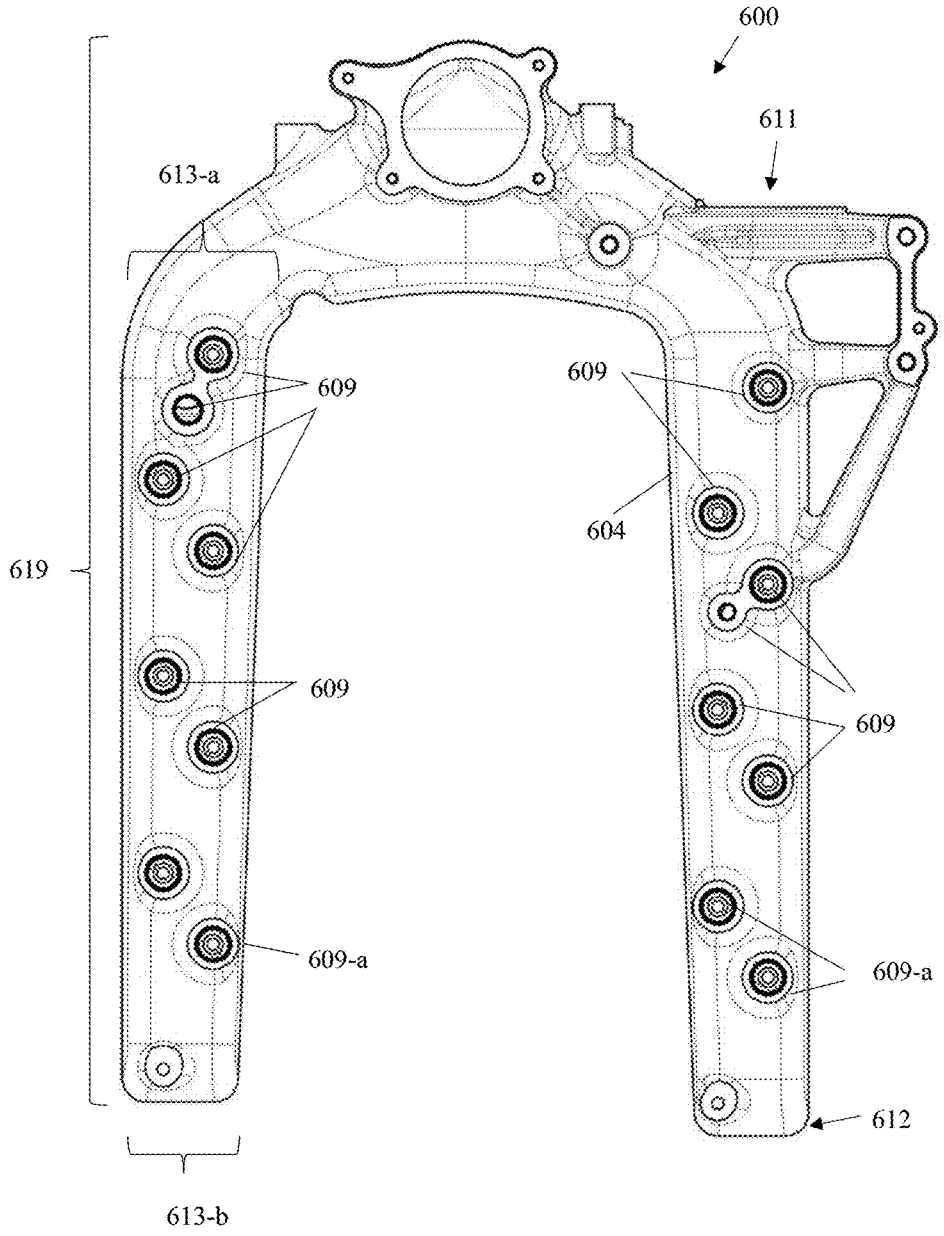
FIG. 6 illustrates the front plan view of another example of a hollow intake manifold, according to an aspect.

FIG. 6 illustrates the front plan view of another example of a hollow intake manifold 600, according to an aspect. Access holes 609 for installing the hollow intake manifold with bolts may be provided on the front side of the hollow intake manifold. The hollow intake manifold may be larger in size and may have different dimensions and a different shape than a stock intake manifold. As will be discussed when referring to FIG. 10, each runner 604 of the hollow intake manifold may be tapered in height, in contrast with a stock intake manifold with runners having a uniform height. As an example, the hollow intake manifold may be approximately 21 and ⅝ inches from point 611 to the end point of a runner 612, while a stock intake manifold may be approximately 21 and ¼ inches between similar points. The width of one runner 613-*a* at the top end of the intake manifold may be approximately 3¼ inches or may be 3 and 5/16 inches, while the width of the corresponding section of a stock intake manifold may be approximately 3 and 1/16 inches or 3 and 3/32 inches. The width 613-*b* at the bottom end of the intake manifold may be 2 and $15/16^{th}$ inches, while the corresponding width of the stock intake manifold may be 2 and $5/8^{th}$ inches. The hollow intake manifold may have an overall length 619, which may be approximately a half inch longer than a stock intake manifold, for example. The hollow intake manifold may also include an end port 609-*a* at the end of each runner 604. The port may be a fully circular port, and may be similar in size and shape as all other ports 609 of the intake manifold. In contrast, the end port of the stock intake manifold may be not fully circular, or may be smaller in size, which may be to accommodate the surrounding parts of the vehicle in which the stock intake manifold is used. The hollow intake manifold may be fitted around a customized vehicle with parts removed, for example, or may be fitted to be used in a vehicle with the removal of any parts, and may be done so by custom measuring and fitting the hollow intake manifold into the vehicle. An advantage may be that air hitting the end port may be pressurized differently than in the stock intake manifold, such that the air flows fully and more uniformly around the circular port with more room than in the stock.

Figure 7:
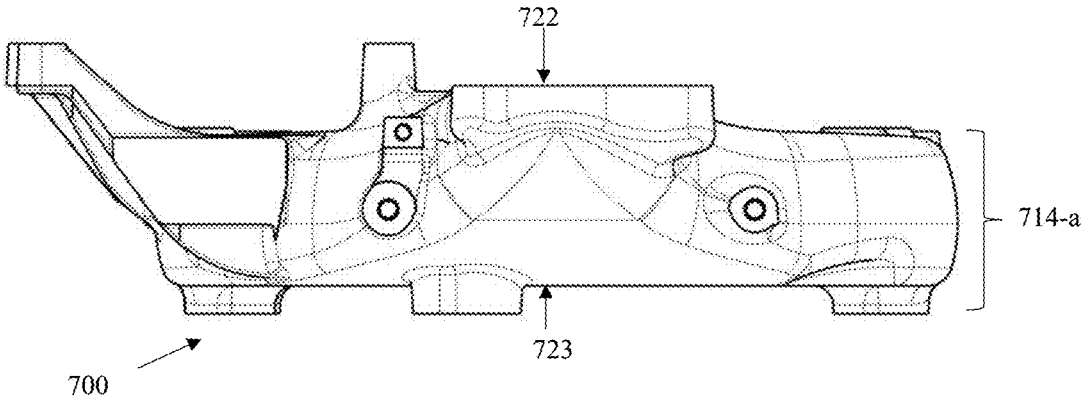
FIG. 7 illustrates the top elevation view of the hollow intake manifold of FIG. 6, according to an aspect.

FIG. 7 illustrates the top elevation view of the hollow intake manifold 700 of FIG. 6, according to an aspect. As an example, the height 714-*a* of the runners at the top end of the hollow intake manifold runner may be approximately 3 and $7/16^{th}$ inches tall, while the height of the top end of a stock intake manifold runner may be approximately 3 and $1/16^{th}$ inches tall. As another example, the height of the runners 714-*a* of the top end of the hollow intake manifold may be 3 and $\frac{3}{4}^{th}$ inches. The height 714-*a* on the inside of the hollow intake manifold from floor to ceiling may be 3 and $\frac{5}{8}^{th}$ inches and the corresponding measurement from inside floor to ceiling in the top side of the stock intake manifold may be 2 and $\frac{3}{16}^{th}$ inches. The height of the intake manifold at its top end from point 722 measured to point 723 may be 3 and $\frac{13}{16}^{th}$ inches, for example.

Figure 8:
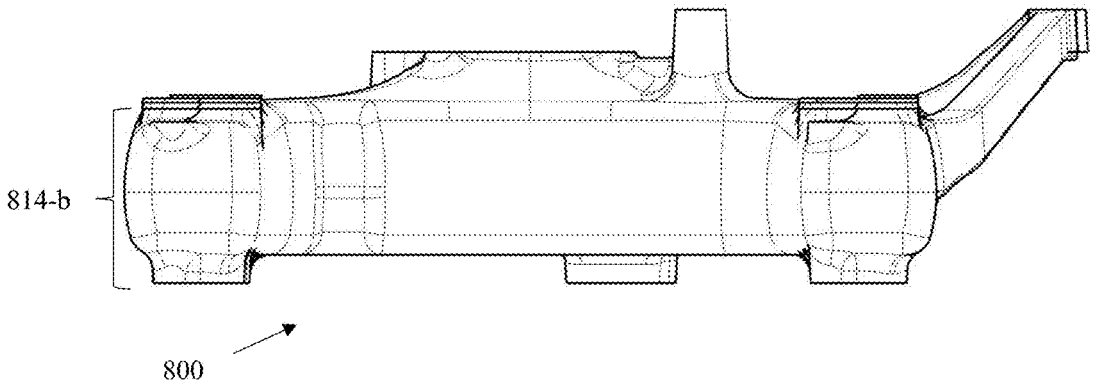
FIG. 8 illustrates the bottom elevation view of the hollow intake manifold of FIG. 6, according to an aspect.

FIG. 8 illustrates the bottom elevation view of the hollow intake manifold 800 of FIG. 6, according to an aspect. As an example, the height of the bottom side 814-*b* may be 2 and $\frac{7}{8}^{th}$ inches in a hollow intake manifold. The corresponding region of a stock intake manifold may be 2 and $\frac{15}{16}^{th}$ inches.

Figure 9:
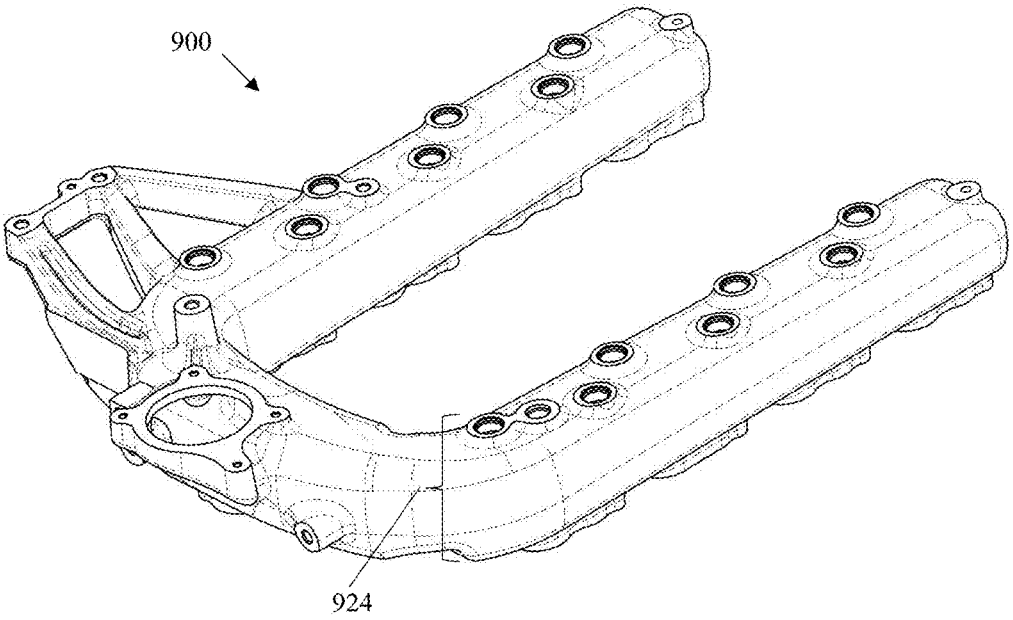
FIG. 9 illustrates the left side perspective view of the hollow intake manifold of FIG. 6, according to an aspect.

FIG. 9 illustrates the left side perspective view of the hollow intake manifold 900 of FIG. 6, according to an aspect. As an example, the height 924 of the corner section of the hollow intake manifold may be 3 and $\frac{11}{16}^{th}$ inches, while the height of the corresponding corner section of the stock intake manifold may be 3 and $\frac{1}{8}^{th}$ inches.

Figure 10:
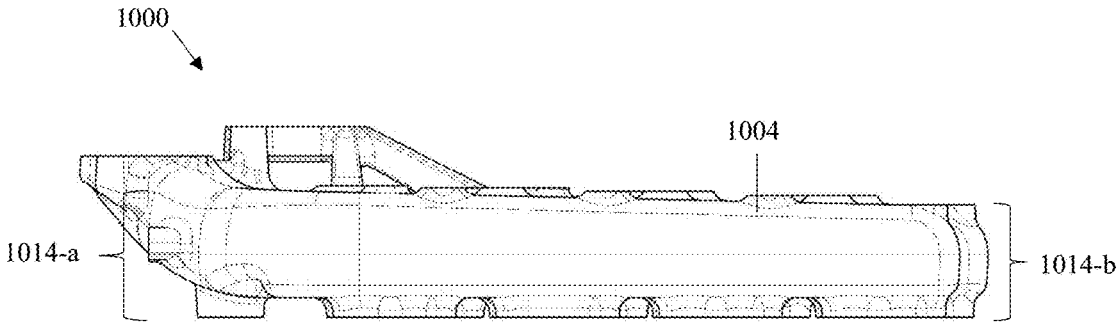
FIG. 10 illustrates the left side elevation view of the hollow intake manifold of FIG. 6, according to an aspect.

FIG. 10 illustrates the left side elevation view of the hollow intake manifold 1000 of FIG. 6, according to an aspect. The hollow intake manifold 1000 may have runners 104 that taper and thus differ in height between the top side 1014-*a* and the bottom side 1014-*b*. The height of the runner at the top side 1014-*a* may be greater than the height of the runner at the bottom side 1014-*b*. As an example, the height 1014-*a* may be 3 and $\frac{3}{4}^{th}$ inches and the height 1014-*b* may be 3 and $\frac{1}{4}$ inches on the hollow intake manifold 1000. The stock intake manifold may have a uniform height throughout its runners, and thus the corresponding heights of the stock intake manifold may be both 3 and $\frac{3}{32}$ inches. As another example, the two heights may be 3 and $\frac{1}{16}^{th}$ inches in the stock intake manifold.

The difference in heights in the hollow intake manifold may be conducive to faster and more efficient air flow than in an intake manifold having a uniform height in its runners. As air travels from the top side 1014-*a* to the bottoms ide 1014-*b*, air may be lost through the ports to the cylinders of the vehicle. According to the laws of fluid dynamics, velocity of a fluid such as air increases when passing through a constriction, such as the tapered runner of the hollow intake manifold. However, due to the loss of air to the cylinders, this effect would not be seen in an intake manifold having a uniform height in its runner, and may have inefficient or slowed air flow towards the bottom end of the intake manifold. The tapered runner may compensate for the loss of air, and thus, help to maintain a constant velocity of air flow throughout the runner. The overall volume of the hollow intake manifold may be 47% greater than a similar stock intake manifold.

Figure 11:
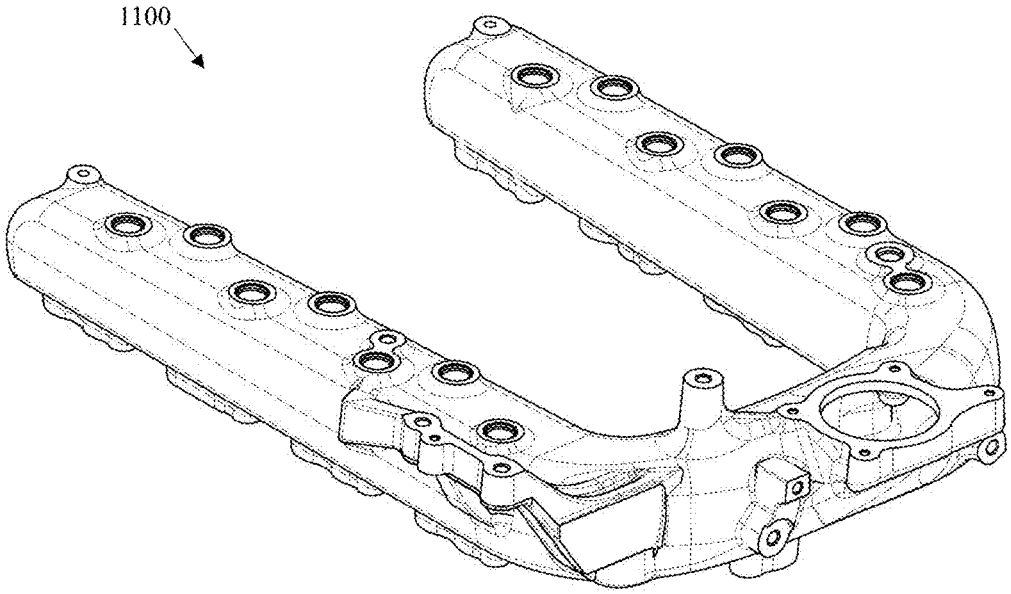
FIG. 11 illustrates the right side perspective view of the hollow intake manifold of FIG. 6, according to an aspect.

FIG. 11 illustrates the right side perspective view of the hollow intake manifold 1100 of FIG. 6, according to an aspect.

Figure 12:
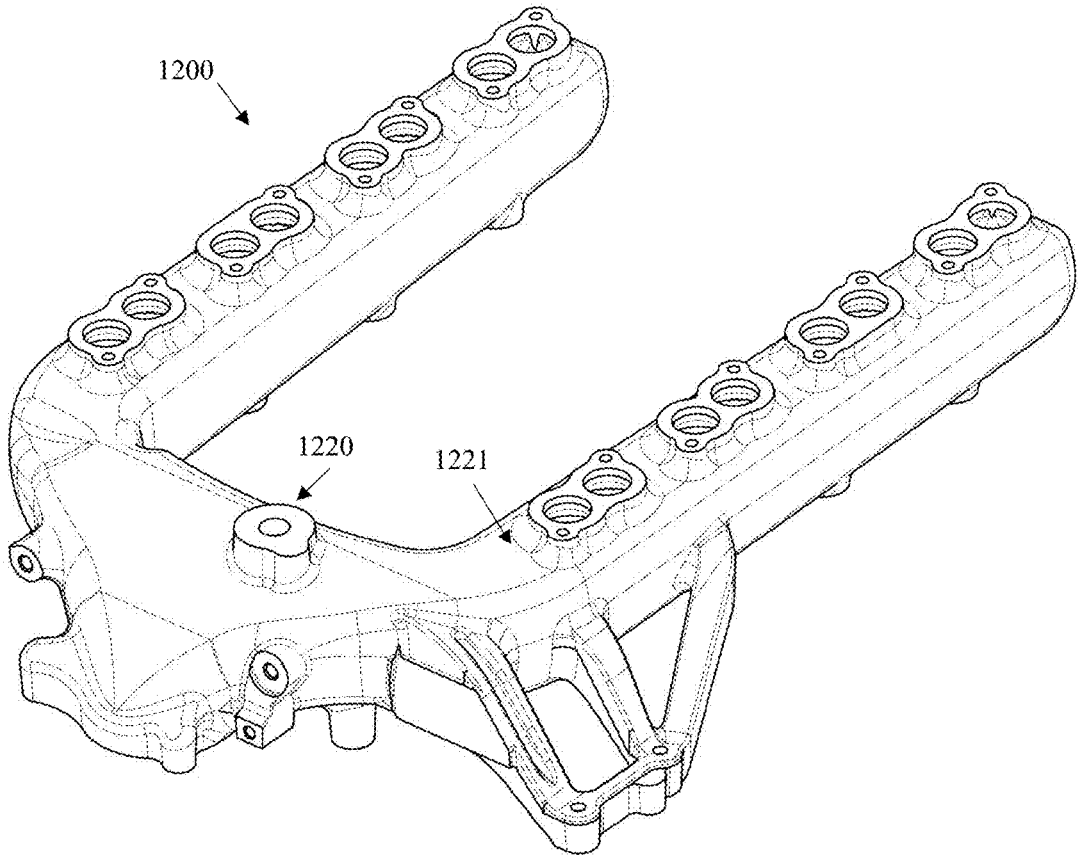
FIG. 12 illustrates the back right perspective view of the hollow intake manifold of FIG. 6, according to an aspect.

FIG. 12 illustrates the back right perspective view of the hollow intake manifold 1200 of FIG. 6, according to an aspect. The distance between points 1220 and 1221, from the center of one runner to the center of the manifold, may be 4 and $\frac{11}{16}^{th}$ inches in the hollow intake manifold 1200. The distance of the corresponding area in a stock intake manifold may be 3 and $\frac{5}{16}^{th}$ inches.

Figure 13:
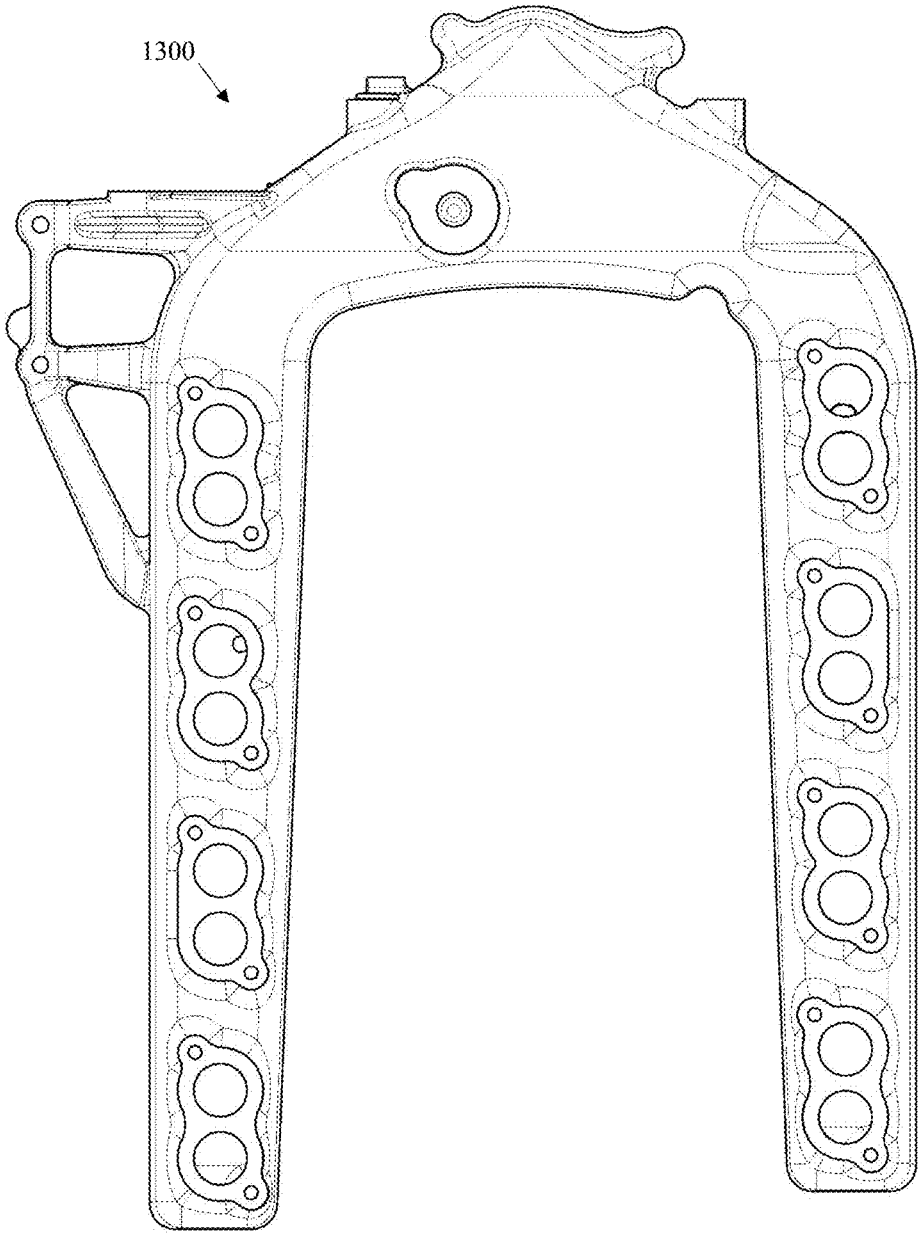
FIG. 13 illustrates the back plan view of the hollow intake manifold of FIG. 6, according to an aspect.

FIG. 13 illustrates the back plan view of the hollow intake manifold 1300 of FIG. 6, according to an aspect.

Figure 14:
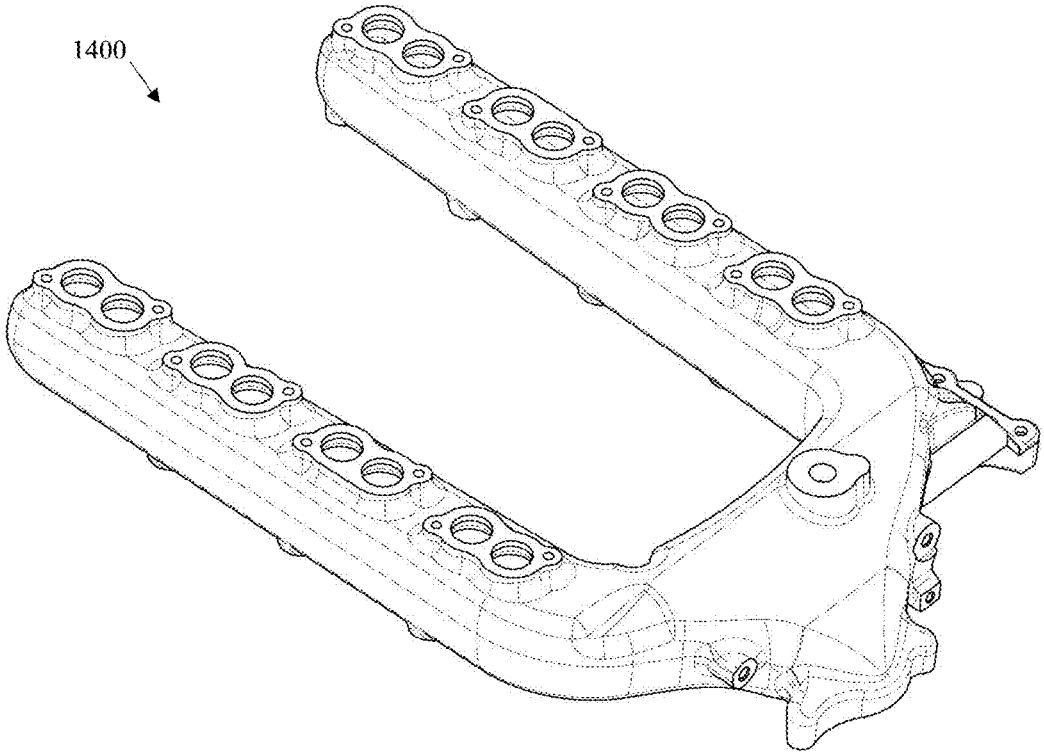
FIG. 14 illustrates the back left perspective view of the hollow intake manifold of FIG. 6, according to an aspect.

FIG. 14 illustrates the back left perspective view of the hollow intake manifold 1400 of FIG. 6, according to an aspect.

As an example, the hollow intake manifold as shown in FIGS. 6-14 may perform with better air flow than in the stock intake manifold such as the manifold shown in FIG. 1B. The stock intake manifold may flow at 490 cubic feet per minute (CFM) of air with a 22% loss of air from the top end of the intake manifold (as shown by 126 in FIG. 1B, also may be referred to as the front) to the bottom end (as shown by 127 in FIG. 1B, also may be referred to as the rear), for example. A modified stock intake manifold such as the manifold shown in FIG. 5A may have improved air flow from the stock intake manifold, with a flow rate of 517 CFM and a 19% loss of air from the top to the bottom, for example. A hollow intake manifold built to have no inner obstructions may have further improved air flow, with a flow rate of 788 CFM and a 2% drop in air flow, for example.

Figure 15:
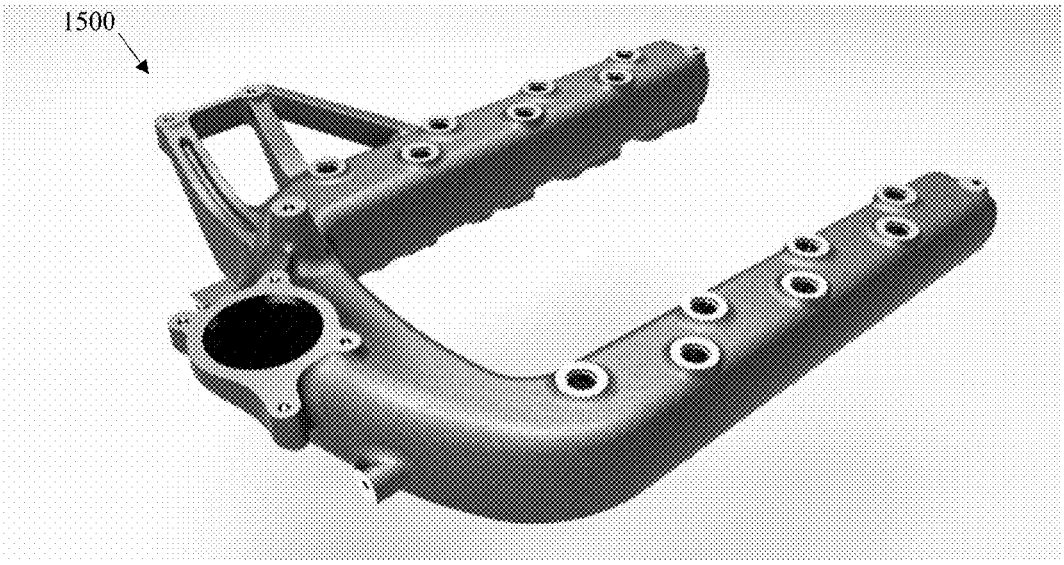
FIG. 15 shows a front perspective view of another example of a hollow intake manifold, according to an aspect.

FIG. 15 shows a front perspective view of another example of a hollow intake manifold 1500, according to an aspect.

Figure 16:
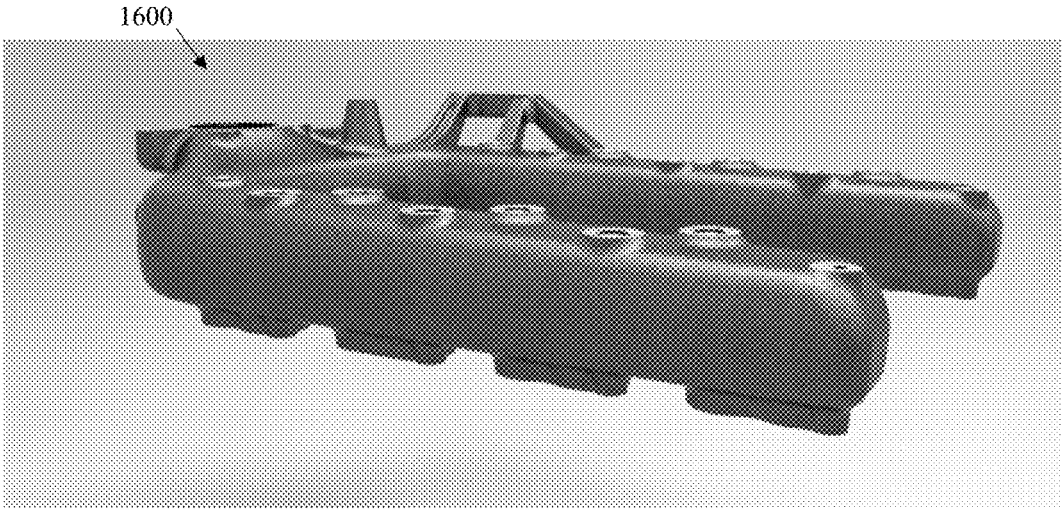
FIG. 16 shows the left side perspective view of the hollow intake manifold of FIG. 15, according to an aspect.

FIG. 16 shows the left side perspective view of the hollow intake manifold 1600 of FIG. 15, according to an aspect.

Figure 17:
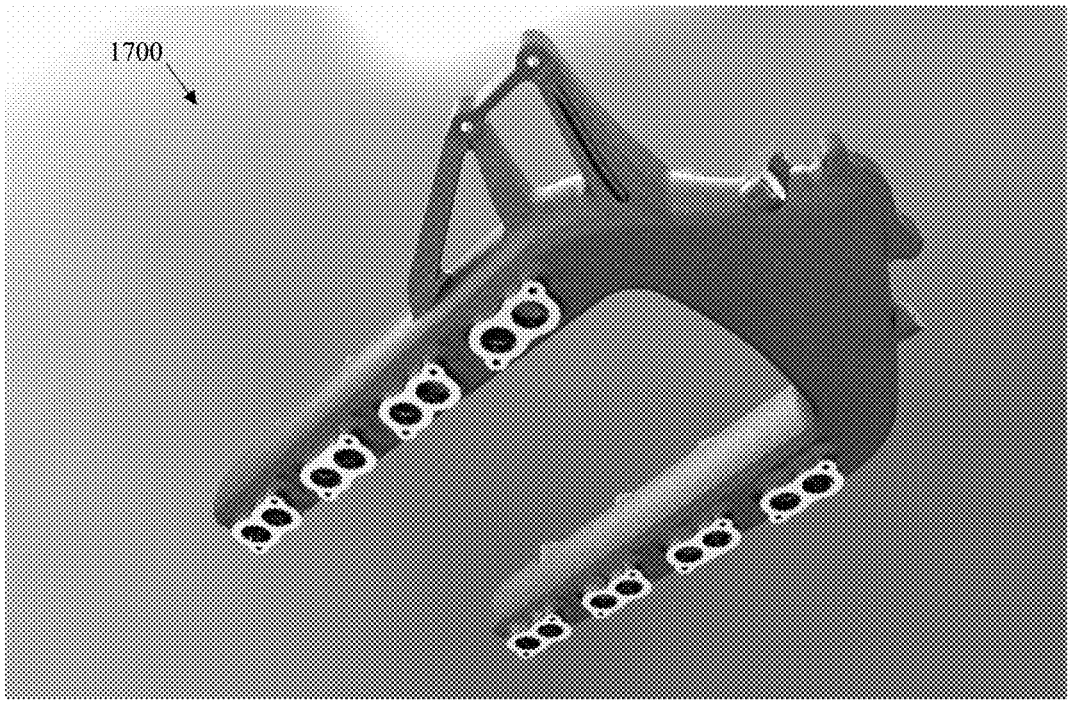
FIG. 17 shows the back perspective view of the hollow intake manifold of FIG. 15, according to an aspect.

FIG. 17 shows the back perspective view of the hollow intake manifold 1700 of FIG. 15, according to an aspect.

Figure 18:
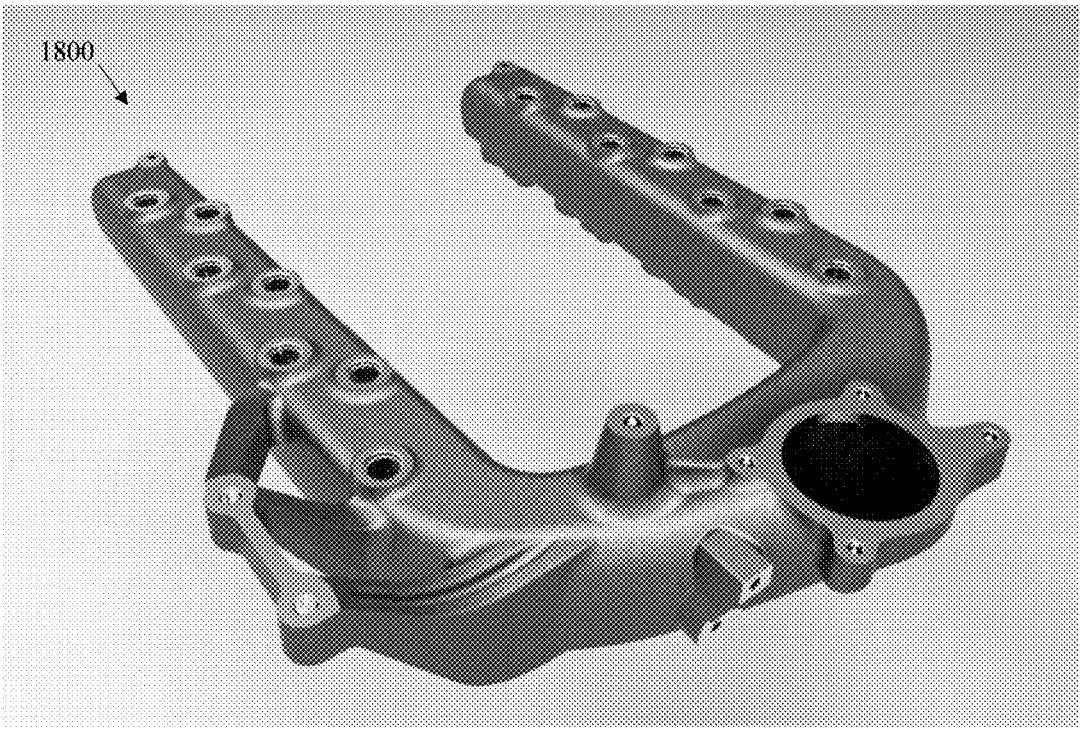
FIG. 18 shows the front top perspective view of the hollow intake manifold of FIG. 15, according to an aspect.

FIG. 18 shows the front top perspective view of the hollow intake manifold 1800 of FIG. 15, according to an aspect.

Figure 19:
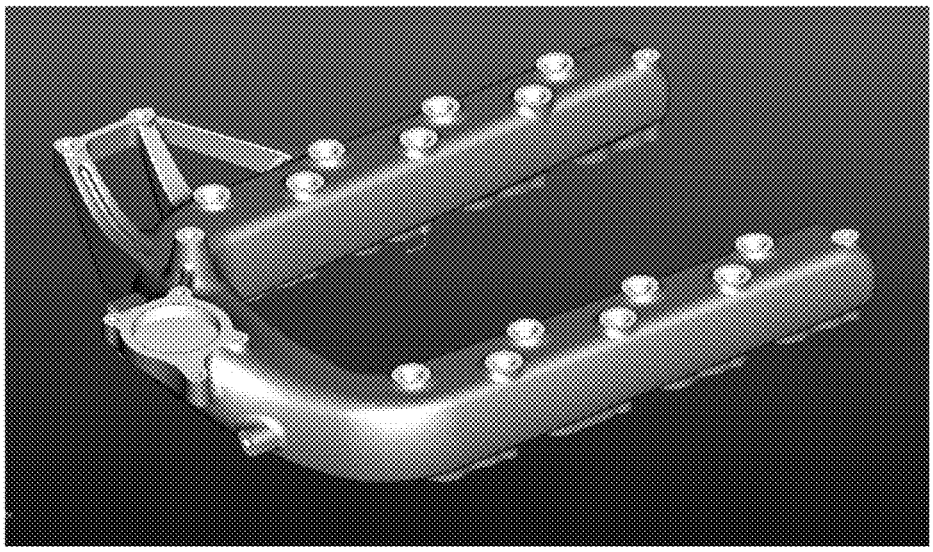
FIG. 19 shows the front side perspective view of the hollow intake manifold of FIG. 15, according to an aspect.

FIG. 19 shows the front side perspective view of the hollow intake manifold 1900 of FIG. 15, according to an aspect.

Figure 20:
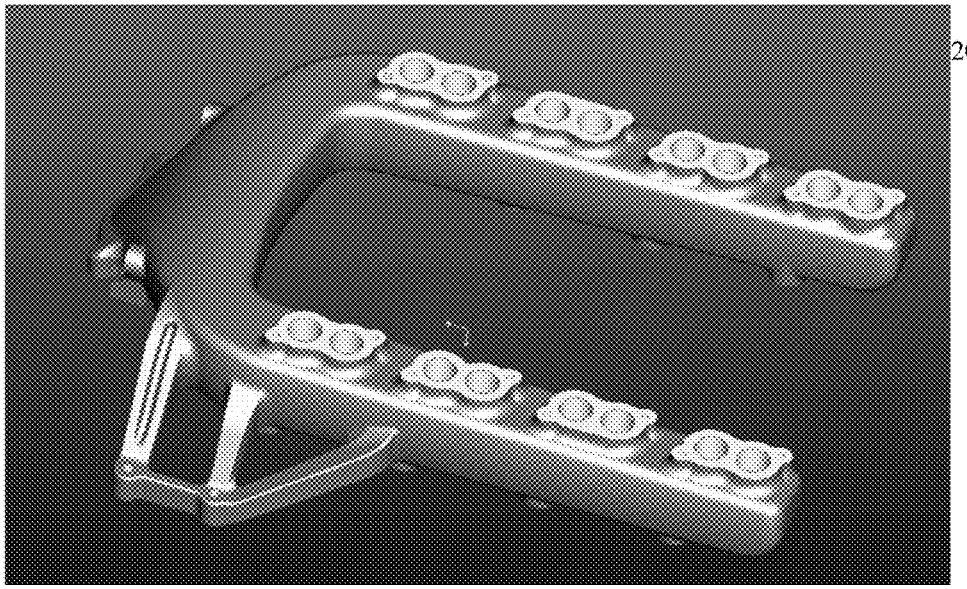
FIG. 20 shows the back side perspective view of the hollow intake manifold of FIG. 15, according to an aspect.

FIG. 20 shows the back side perspective view of the hollow intake manifold 2000 of FIG. 15, according to an aspect.

Figure 21:
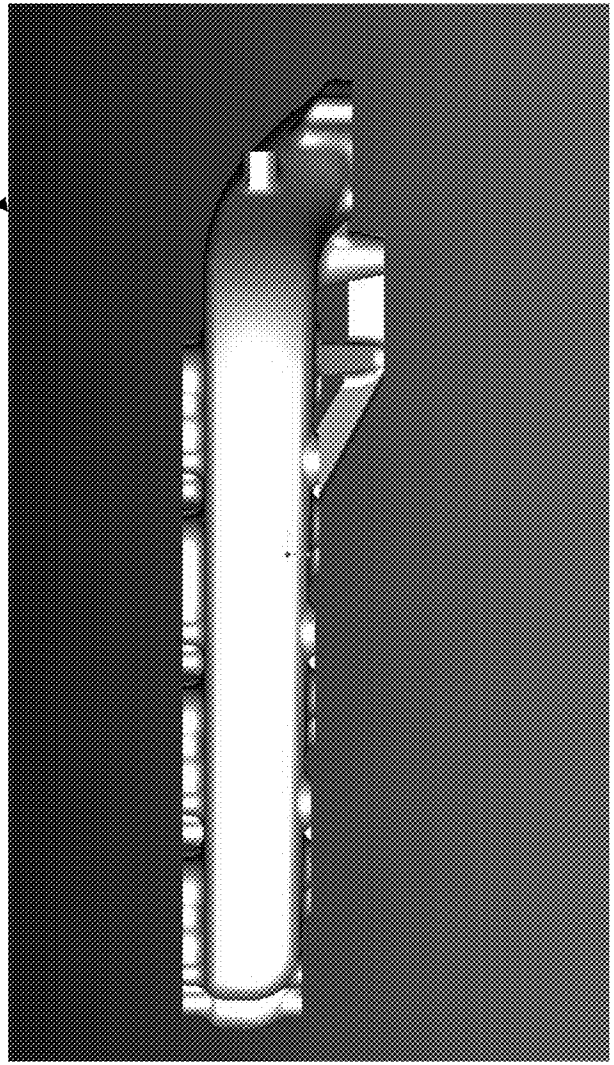
FIG. 21 shows the left side elevation view of the hollow intake manifold of FIG. 15, according to an aspect.

FIG. 21 shows the left side elevation view of the hollow intake manifold 2100 of FIG. 15, according to an aspect.

Figure 22:
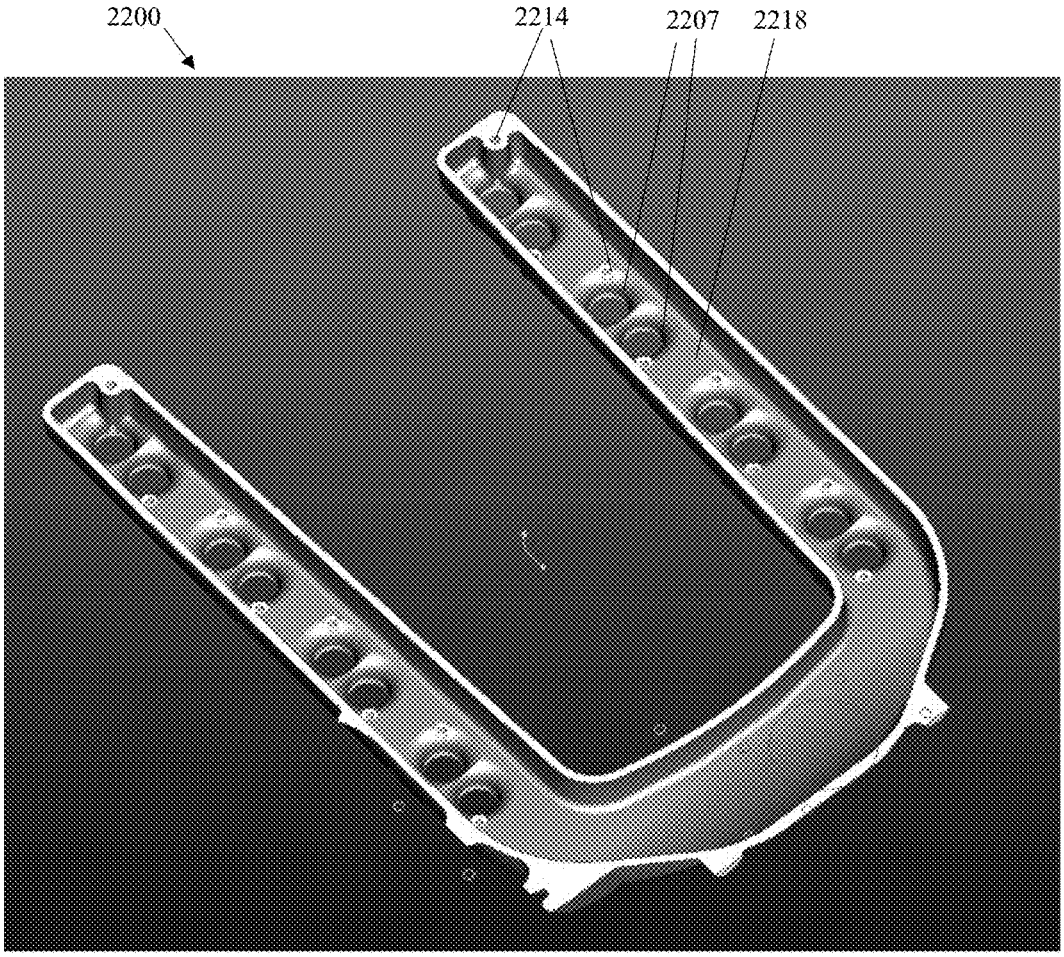
FIG. 22 shows the horizontal sectional view of the hollow intake manifold of FIG. 15, showing the inner floor, according to an aspect.

FIG. 22 shows the horizontal sectional view of the hollow intake manifold 2200 of FIG. 15, showing the inner floor 2218, according to an aspect. The interior of the hollow intake manifold may be free of any obstructions, and may eliminate posts or pillars that extend from the top to bottom of the interior of the intake manifold. The inner floor 2218 may include a plurality of cylinder head holes 2207 for delivering the air/fuel mixture to the engine cylinder heads. As an example, a hollow intake manifold may be used for a V8 engine, thus, eight cylinder head holes may be provided in each runner, for a total of sixteen cylinder head holes such that there are two cylinder head holes 2207 per each engine cylinder head, and the cylinder head holes correspond with the engine's cylinder head openings. Each pair of cylinder head holes 2207 may also be next to at least one bolt hole 2214. As shown, each pair of cylinder head holes 2207 may be next to two bolt holes 2214. Each runner may also include a bolt hole 2214 at its end. Each cylinder head hole 2207 may have a continuously rounded and sloped shape, in contrast with an angular shape that may be present in stock intake manifolds. An advantage of the rounded shape may be that air flowing through the interior space of the runner may more easily and quickly flow down into the vehicle cylinder heads through the rounded cylinder head holes than through angular cylinder head holes, which may obstruct or interrupt air flow.

Tests were conducted by Dynamic Diesel Performance and Machine Inc. to measure the intake volume of various intake manifolds. Test #1 tested a stock 6.0 L Power Stroke Diesel intake manifold, which yielded an intake volume of 2986 cubic centimeters (cc). Test #2 tested a partially modified ("ported") stock 6.0 L Power Stroke Diesel Intake Manifold, having only its inner stand pipes deleted or machined out, which yielded an intake volume of 3046 cc. Test #3 tested a fully ported stock 6.0 L Power Stroke Diesel intake manifold, with all inside components and obstructions removed, which yielded 3845 cc. Test #4 tested a newly casted intake manifold designed and ported by hand by Odawgs Diesel (model "S3R") which yielded 5442 cc. Testing was performed using tap water, and measurements were conducted with a 60 cc (2 oz) syringe. The test was performed as known in the art, a standard water test with sealing the intake, placing the intake manifold bottom side up, filling with water, and calculating the cc measurements.

Additional testing was performed by Dynamic Diesel Performance and Machine Inc. using a Super Flow SF-110FC (a standard flow bench). The tests were run on 6.0 L intake manifolds, with a flow at 28 inches of water. The maximum intake flow of the stock intake manifold was 567 CFM. The maximum intake flow for the Stage 3 (model "S3," ported by hand) was 643 CFM. The maximum intake flow for the newly designed S3 intake manifold was 788 CFM. A new S3 with CNC-cut ported cylinder heads was also tested, and the maximum intake flow was 856 CFM.

Figures 23A, 23B:
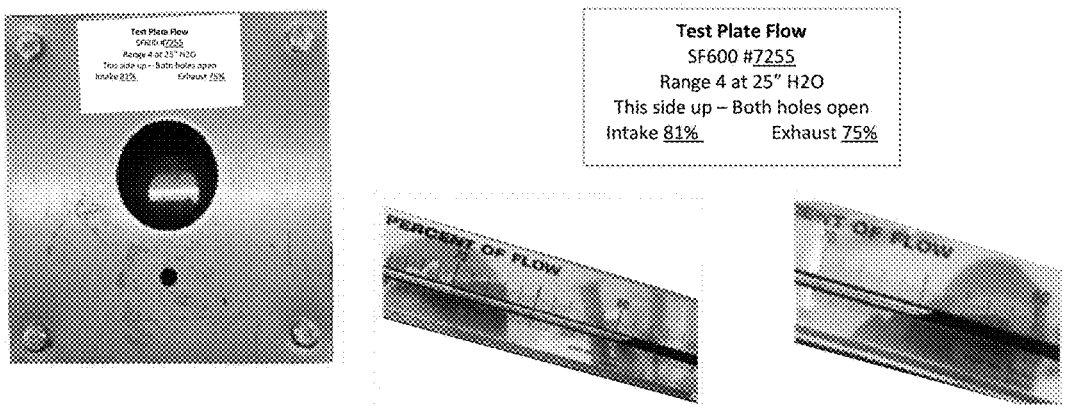
FIG. 23A shows test results from additional experiments conducted to determine the test plate flow of the calibration at 25 inches of water.
FIG. 23B is a table summarizing the results of the calibration test.

FIG. 23A shows test results from additional experiments conducted to determine the test plate flow of the calibration at 25 inches of water. As shown, the percentage flow was found to be 81% in the intake, and 75% in the exhaust.

Figure 25A:
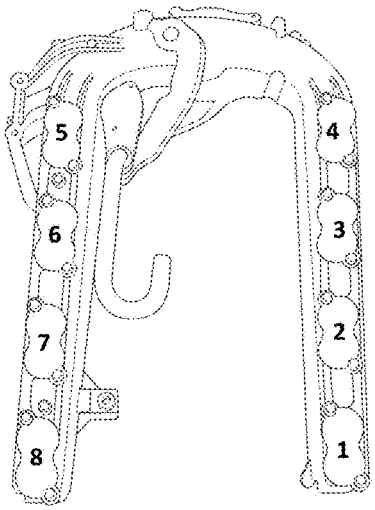
FIG. 25A shows an intake manifold with numbers to indicate the port pairs that were tested in the individual port flow test using 10 inches of water.

FIG. 23B is a table summarizing the results of the calibration test for the intake manifold shown in FIG. 25A.

FIGS. 24A-24B are tables summarizing the results of a flow test for a stock intake manifold and a stage 3 intake manifold, respectively. A flow test was performed to compare the flow percentages of the Stock (S) Intake Manifold and the Stage 3 (S3) Intake Manifold. Three different pressures (as known in the art as a national standard for flow testing) were utilized for testing: 10 inches of water, 25 inches of water, and 28 inches of water. Each port of both manifolds was measured for flow (CFM) and restriction pressure (H2O).

Test using 10" of water

S—Port 1 yielded 97 CFM flow with a restriction pressure of 6.94 inches of water.

S3—Port 1 yielded 134 CFM flow with a restriction pressure of 9.44 inches of water.

S—Port 2 yielded 100 CFM flow with a restriction pressure of 6.5 inches of water.

S3—Port 2 yielded 130 CFM flow with a restriction pressure of 9.95 inches of water.

S—Port 3 yielded 107 CFM flow with a restriction pressure of 5.73 inches of water.

S3—Port 3 yielded 130 CFM flow with a restriction pressure of 9.97 inches of water.

S—Port 4 yielded 124 CFM flow with a restriction pressure of 4.3 inches of water.

S3—Port 4 yielded 136 CFM flow with a restriction pressure of 9.18 inches of water.

S—Port 5 yielded a 117 CFM flow with a restriction pressure of 4.75 inches of water.

S3—Port 5 yielded a 139 CFM flow with a restriction pressure of 8.85 inches of water.

S—Port 6 yielded a 106 CFM flow with a restriction pressure of 5.82 inches of water.

S3—Port 6 yielded a 134 CFM flow with a restriction pressure of 9.53 inches of water.

S—Port 7 yielded a 98 CFM flow with a restriction pressure of 6.74 inches of water.

S3—Port 7 yielded a 131 CFM flow with a restriction pressure of 9.93 inches of water.

S—Port 8 yielded a 92 CFM flow with a restriction pressure of 7.49 inches of water.

S3—Port 8 yielded a 136 CFM flow with a restriction pressure of 9.94 inches of water.

Test using 25" of water

S—Port 1 yielded 158 CFM flow with a restriction pressure of 22.28 inches of water.

S3—Port 1 yielded 213 CFM flow with a restriction pressure of 23.36 inches of water.

S—Port 2 yielded 163 CFM flow with a restriction pressure of 20.85 inches of water.

S3—Port 2 yielded 202 CFM flow with a restriction pressure of 24.93 inches of water.

S—Port 3 yielded 174 CFM flow with a restriction pressure of 18.45 inches of water.

S3—Port 3 yielded 205 CFM flow with a restriction pressure of 24.98 inches of water.

S—Port 4 yielded 200 CFM flow with a restriction pressure of 13.81 inches of water.

S3—Port 4 yielded 214 CFM flow with a restriction pressure of 22.55 inches of water.

S—Port 5 yielded a 185 CFM flow with a restriction pressure of 15.98 inches of water.

S3—Port 5 yielded a 218 CFM flow with a restriction pressure of 21.73 inches of water.

S—Port 6 yielded a 168 CFM flow with a restriction pressure of 19.65 inches of water.

S3—Port 6 yielded a 210 CFM flow with a restriction pressure of 23.07 inches of water.

S—Port 7 yielded a 156 CFM flow with a restriction pressure of 22.7 inches of water.

S3—Port 7 yielded a 203 CFM flow with a restriction pressure of 24.93 inches of water.

S—Port 8 yielded a 150 CFM flow with a restriction pressure of 24.89 inches of water.

S3—Port 8 yielded a 212 CFM flow with a restriction pressure of 24.96 inches of water.

Test using 28" of water

S—Port 1 yielded 167 CFM flow with a restriction pressure of 25.21 inches of water.

S3—Port 1 yielded 222 CFM flow with a restriction pressure of 27 inches of water.

S—Port 2 yielded 172 CFM flow with a restriction pressure of 23.91 inches of water.

S3—Port 2 yielded 213 CFM flow with a restriction pressure of 27.95 inches of water.

S—Port 3 yielded 184 CFM flow with a restriction pressure of 20.75 inches of water.

S3—Port 3 yielded 211 CFM flow with a restriction pressure of 27.96 inches of water.

S—Port 4 yielded 215 CFM flow with a restriction pressure of 15.35 inches of water.

S3—Port 4 yielded 224 CFM flow with a restriction pressure of 26.25 inches of water.

S—Port 5 yielded a 197 CFM flow with a restriction pressure of 18.2 inches of water.

S3—Port 5 yielded a 230 CFM flow with a restriction pressure of 24.7 inches of water.

S—Port 6 yielded a 178 CFM flow with a restriction pressure of 22.21 inches of water.

S3—Port 6 yielded a 218 CFM flow with a restriction pressure of 27.97 inches of water.

S—Port 7 yielded a 164 CFM flow with a restriction pressure of 26.11 inches of water.

S3—Port 7 yielded a 215 CFM flow with a restriction pressure of 27.95 inches of water.

S—Port 8 yielded a 158 CFM flow with a restriction pressure of 27.89 inches of water.

S3—Port 8 yielded a 225 CFM flow with a restriction pressure of 27.94 inches of water.

FIG. 25A shows an intake manifold with numbers to indicate the port pairs that were tested in the individual port flow test using 10 inches of water.

Figure 25B:
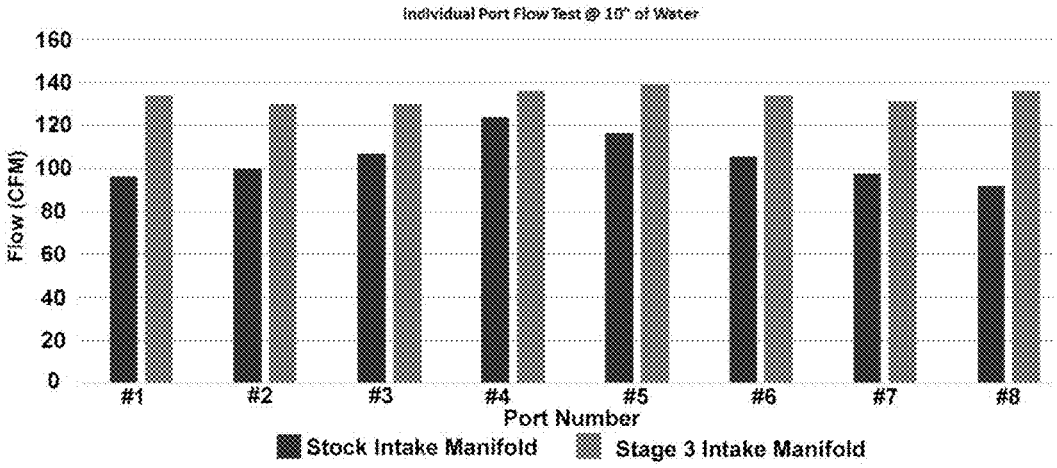
FIG. 25B is a bar graph summarizing the results of the individual port flow test using 10 inches of water, for the eight port pairs shown in FIG. 25A.

FIG. 25B is a bar graph summarizing the results of the individual port flow test using 10 inches of water, for the eight port pairs shown in FIG. 25A.

Figure 26:
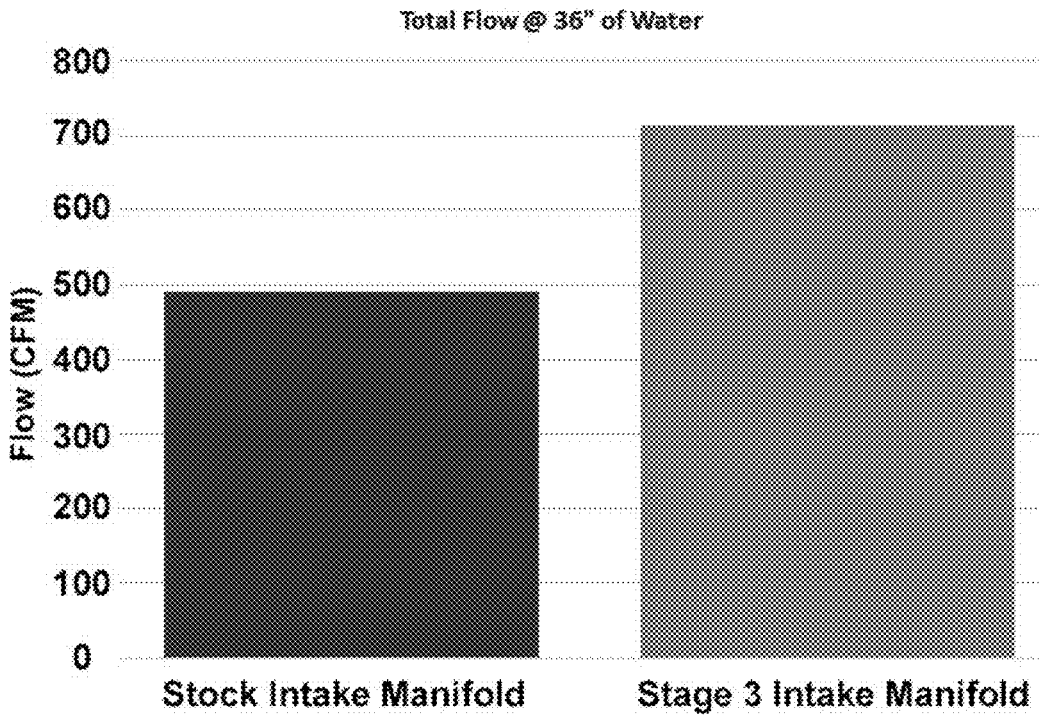
FIG. 26 is a bar graph summarizing the results of a test of the total flow for a stock intake manifold and a stage 3 intake manifold at 36 inches of water.

FIG. 26 is a bar graph summarizing the results of a test of the total flow for a stock intake manifold and a stage 3 intake manifold at 36 inches of water. The total flow was measured for each intake at 36 inches of water. The Stock Intake Manifold had a total flow of about 490 CFM, while the Stage 3 Intake Manifold had a flow of about 710 CFM.

FIG. 27 is a chart summarizing the results and conclusions of the flow tests performed for the stock intake manifold and the stage 3 intake manifold. In conclusion, the Flow Test revealed that the Stage 3 Intake Manifold had a 46% increase in flow compared to the Stock Intake Manifold. The Stage 3 Intake Manifold also demonstrated an 18% increase in air distribution in comparison to the Stock Intake Manifold.

Figure 28:
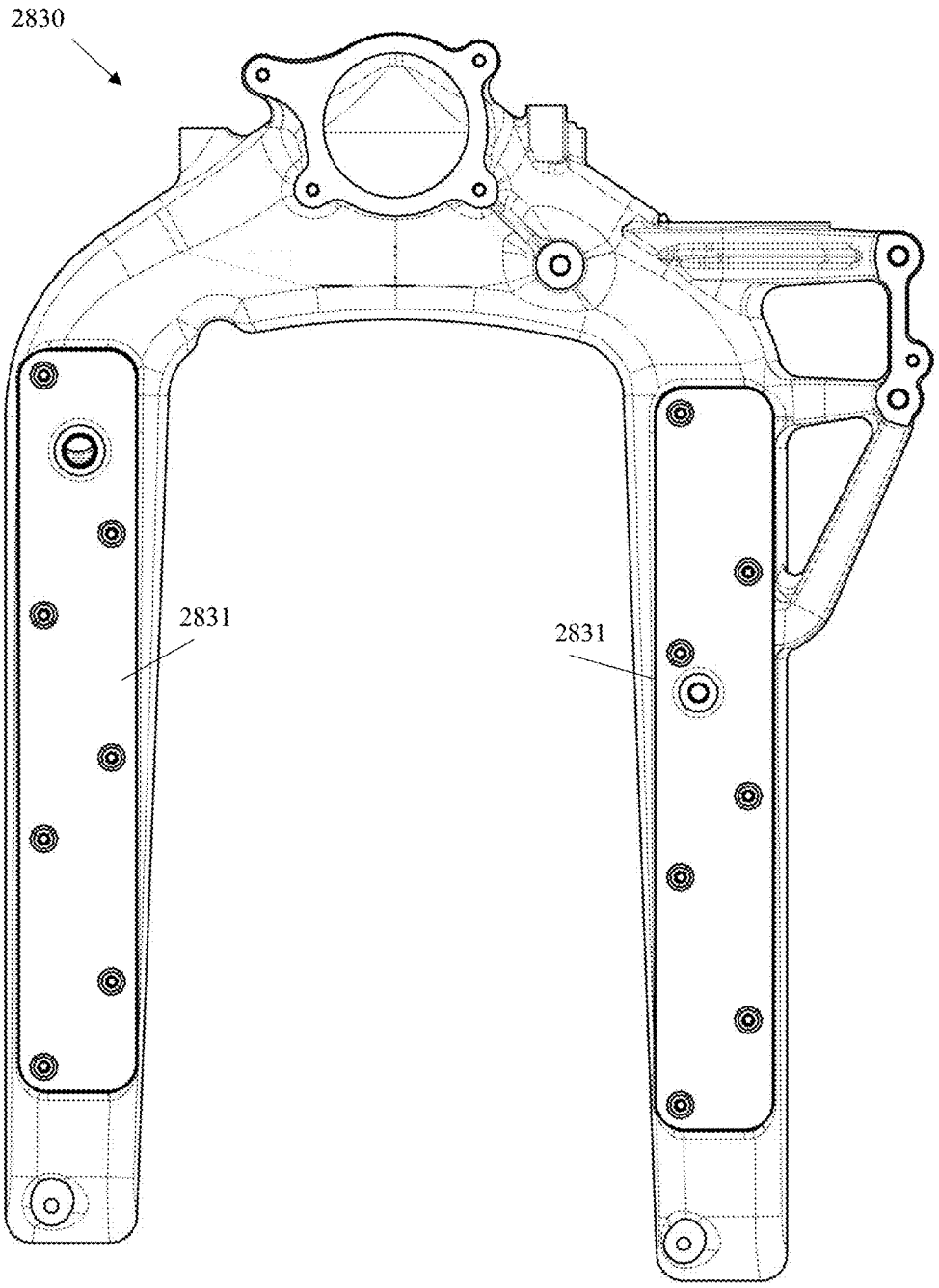
FIG. 28 illustrates the front plan view of another example of a hollow intake manifold 2830 having plated tops, according to an aspect.

FIG. 28 illustrates the front plan view of another example of a hollow intake manifold 2830 having plated tops 2831, according to an aspect. The hollow intake manifold may be constructed to receive plated tops ("plated tops," "covers," or "plates") 2831 over its runners such that all access holes of one runner (as shown by 609 in FIG. 6) may be covered by a single plate. The plated tops may be removable top covers for sealing the access holes and may be received by the main body of the intake manifold, and may further include bolt holes for receiving bolts, for securing the removable top covers to the main body of the intake manifold. The main body of the intake manifold may comprise a runner of the intake manifold without its top wall or side. Each runner may receive a removable top cover. An advantage may be that assembly of and sealing the holes of the hollow intake manifold 2830 may be faster and more efficient for the user in contrast with using a hollow intake manifold wherein each access hole may need to be sealed or covered individually. The hollow intake manifold with plated tops 2831 may be constructed without EGR components, for example.

Figure 29:
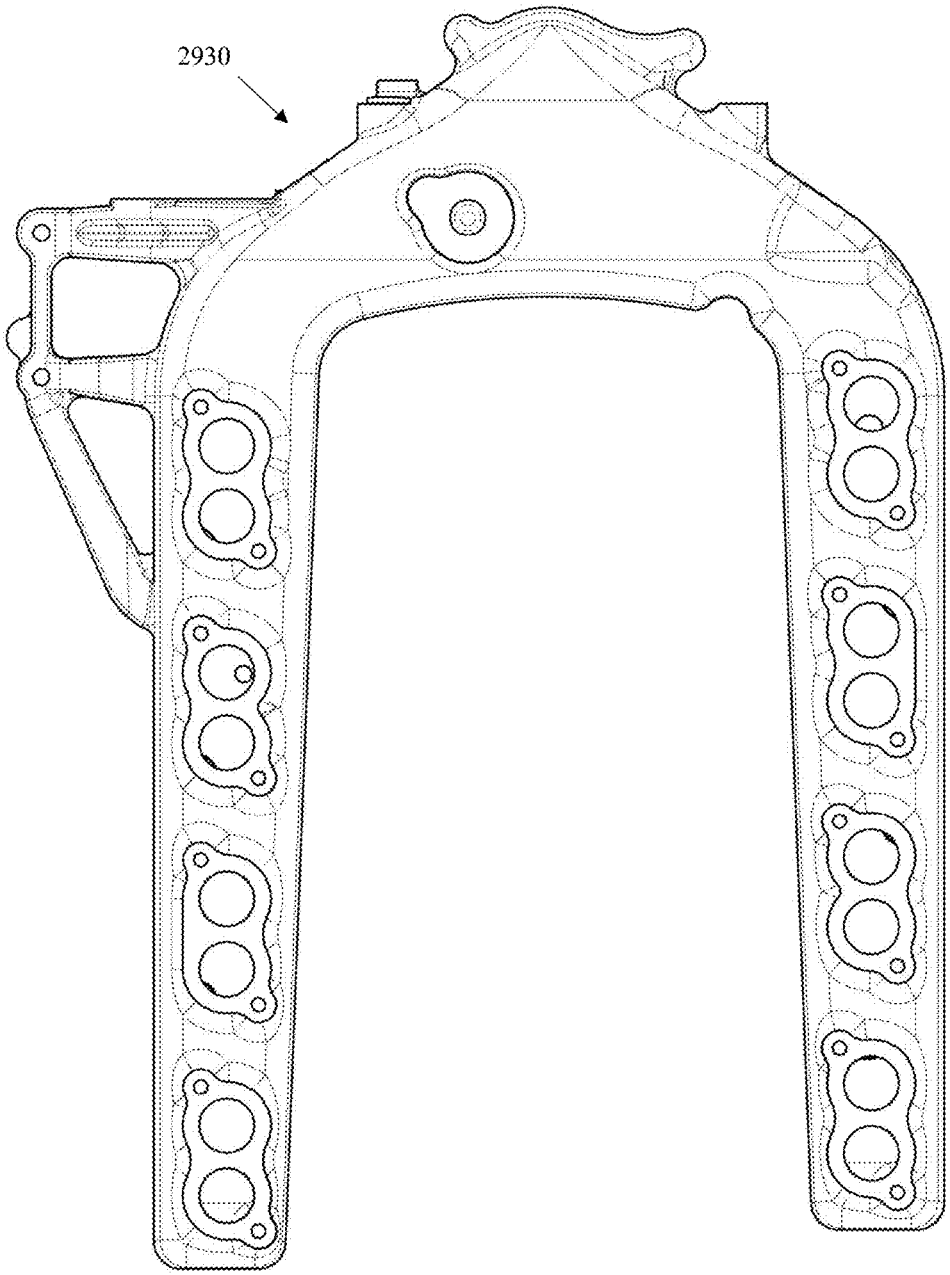
FIG. 29 illustrates the back plan view of the hollow intake manifold of FIG. 28, according to an aspect.

FIG. 29 illustrates the back plan view of the hollow intake manifold 2930 of FIG. 28, according to an aspect.

Figure 30:
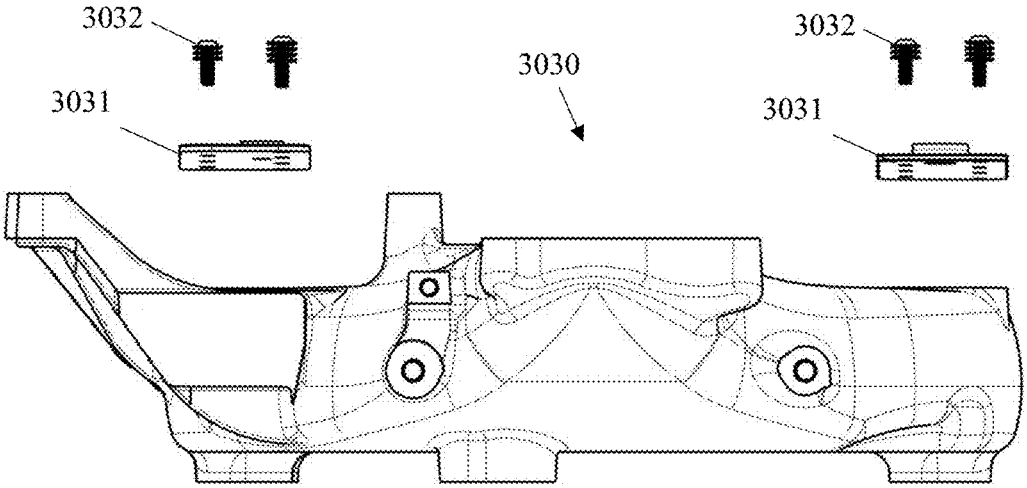
FIG. 30 illustrates the exploded top elevation view of the hollow intake manifold of FIG. 28, according to an aspect.

FIG. 30 illustrates the exploded top elevation view of the hollow intake manifold 3030 of FIG. 28, according to an aspect. Each plate 3031 may be attached to the hollow intake manifold by bolts 3032, for example, or any other suitable method of securing the plate to the manifold.

Figure 31:
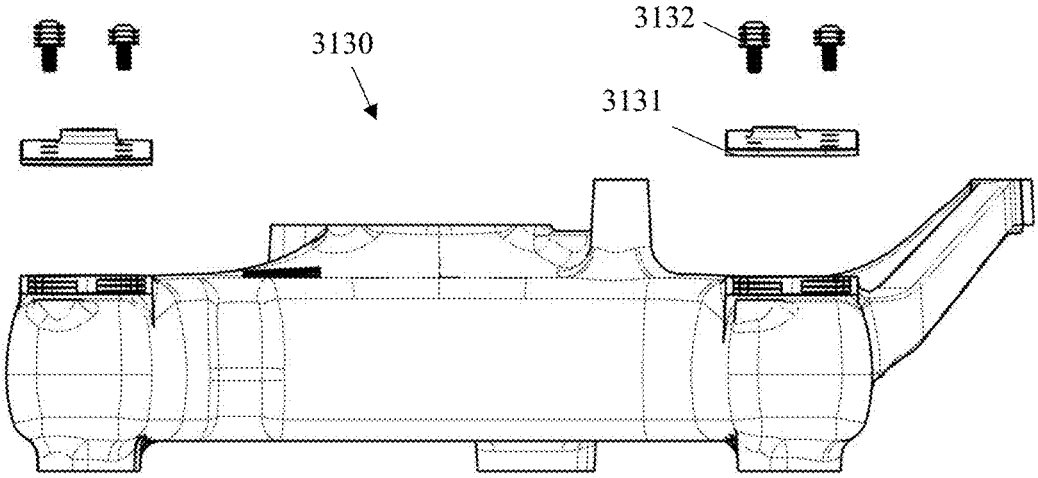
FIG. 31 illustrates the exploded bottom elevation view of the hollow intake manifold of FIG. 28, according to an aspect.

FIG. 31 illustrates the exploded bottom elevation view of the hollow intake manifold 3030 of FIG. 28, according to an aspect. Again, each plate 3131 may be attached to the hollow intake manifold by bolts 3132, for example, or any other suitable method of securing the plate to the manifold.

Figure 32:
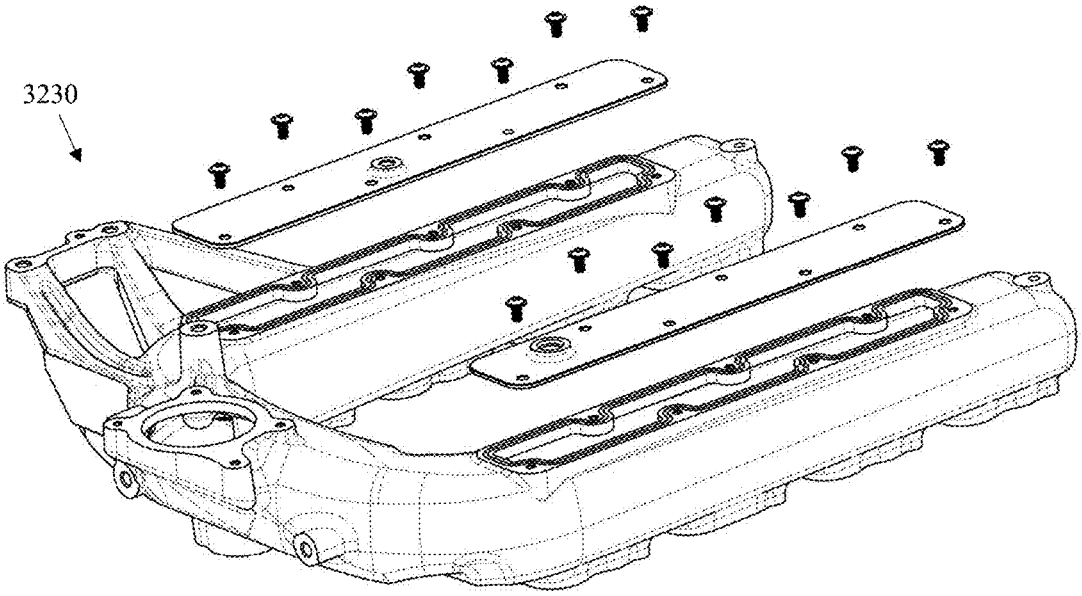
FIG. 32 illustrates the exploded left front perspective view of the hollow intake manifold of FIG. 28, according to an aspect.

FIG. 32 illustrates the exploded left front perspective view of the hollow intake manifold 3130 of FIG. 28, according to an aspect.

Figure 33:
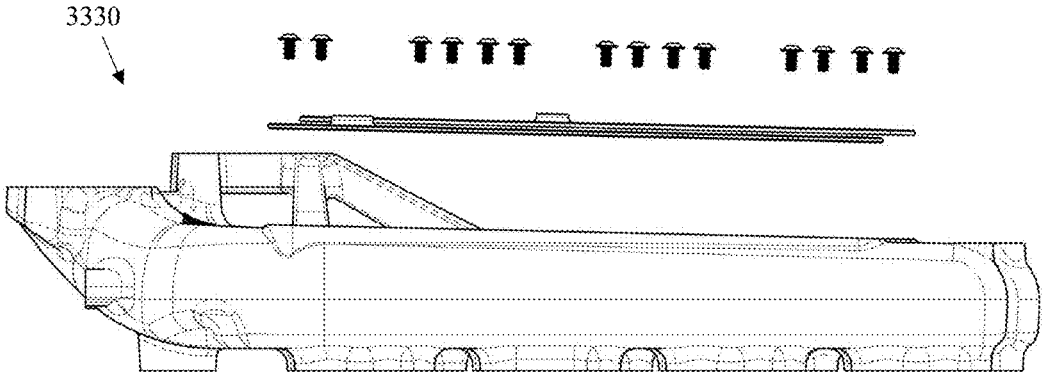
FIG. 33 illustrates the exploded left side elevation view of the hollow intake manifold of FIG. 28, according to an aspect.

FIG. 33 illustrates the exploded left side elevation view of the hollow intake manifold 3130 of FIG. 28, according to an aspect.

Figure 34:
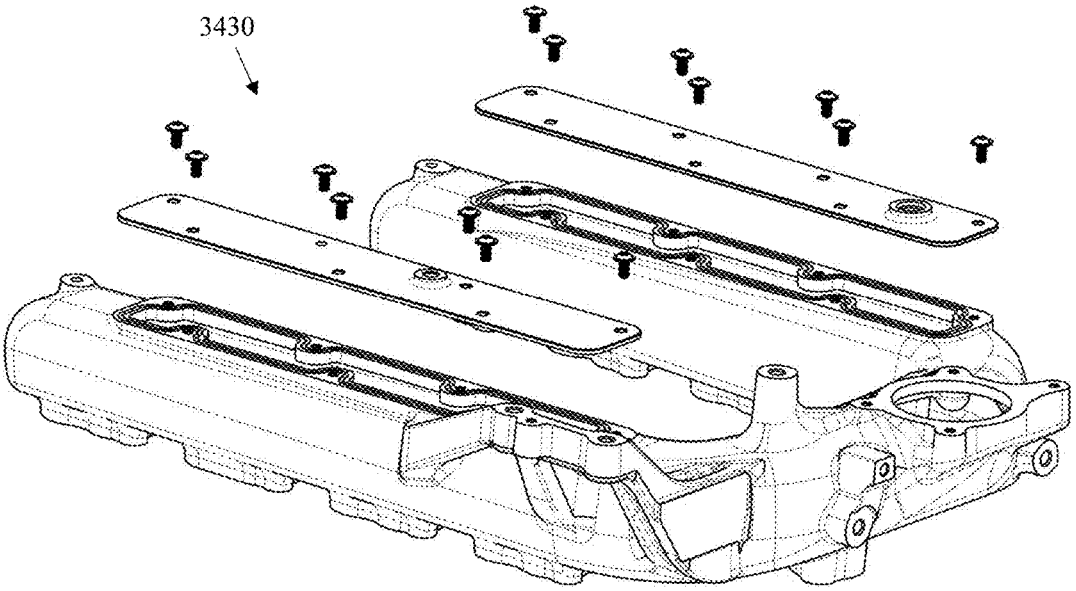
FIG. 34 illustrates the exploded right front perspective view of the hollow intake manifold of FIG. 28, according to an aspect.

FIG. 34 illustrates the exploded right front perspective view of the hollow intake manifold 3430 of FIG. 28, according to an aspect.

Figure 35:
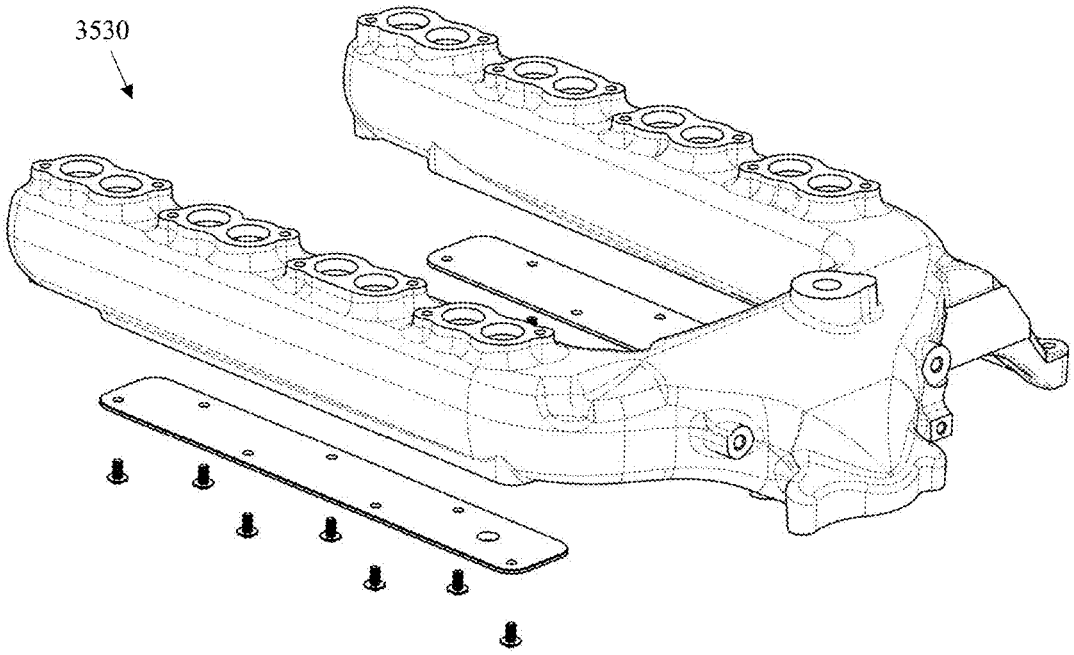
FIG. 35 illustrates the exploded back left perspective view of the hollow intake manifold of FIG. 28, according to an aspect.

FIG. 35 illustrates the exploded back left perspective view of the hollow intake manifold 3530 of FIG. 28, according to an aspect.

Figure 36:
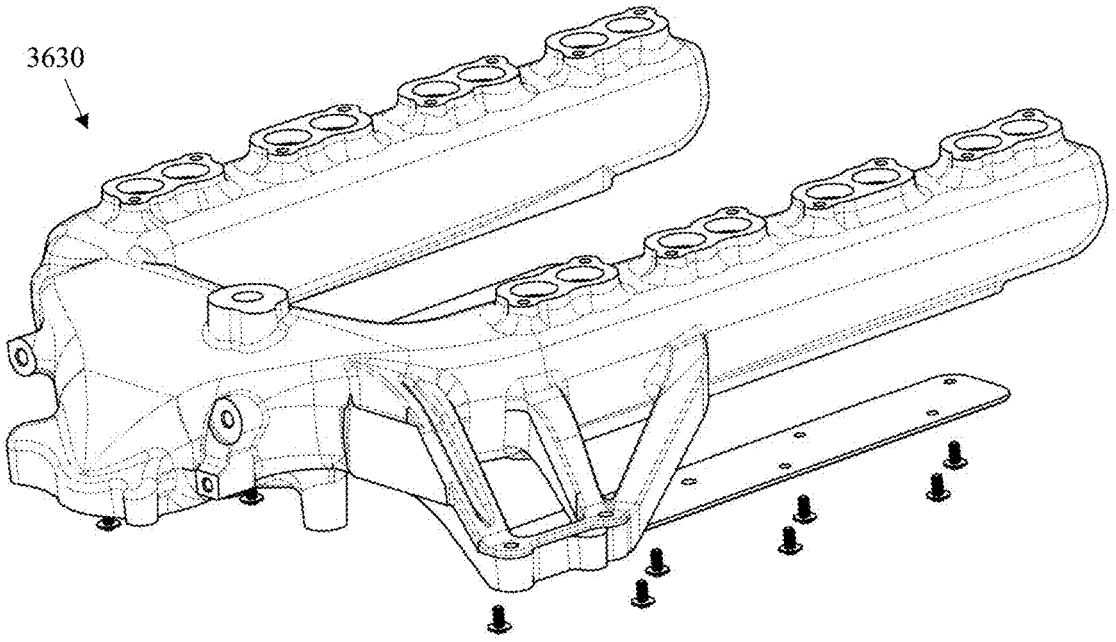
FIG. 36 illustrates the back right perspective view of the hollow intake manifold with plated top of FIG. 28, according to an aspect.

FIG. 36 illustrates the back right perspective view of the hollow intake manifold with plated top 3630 of FIG. 28, according to an aspect.

Figure 37:
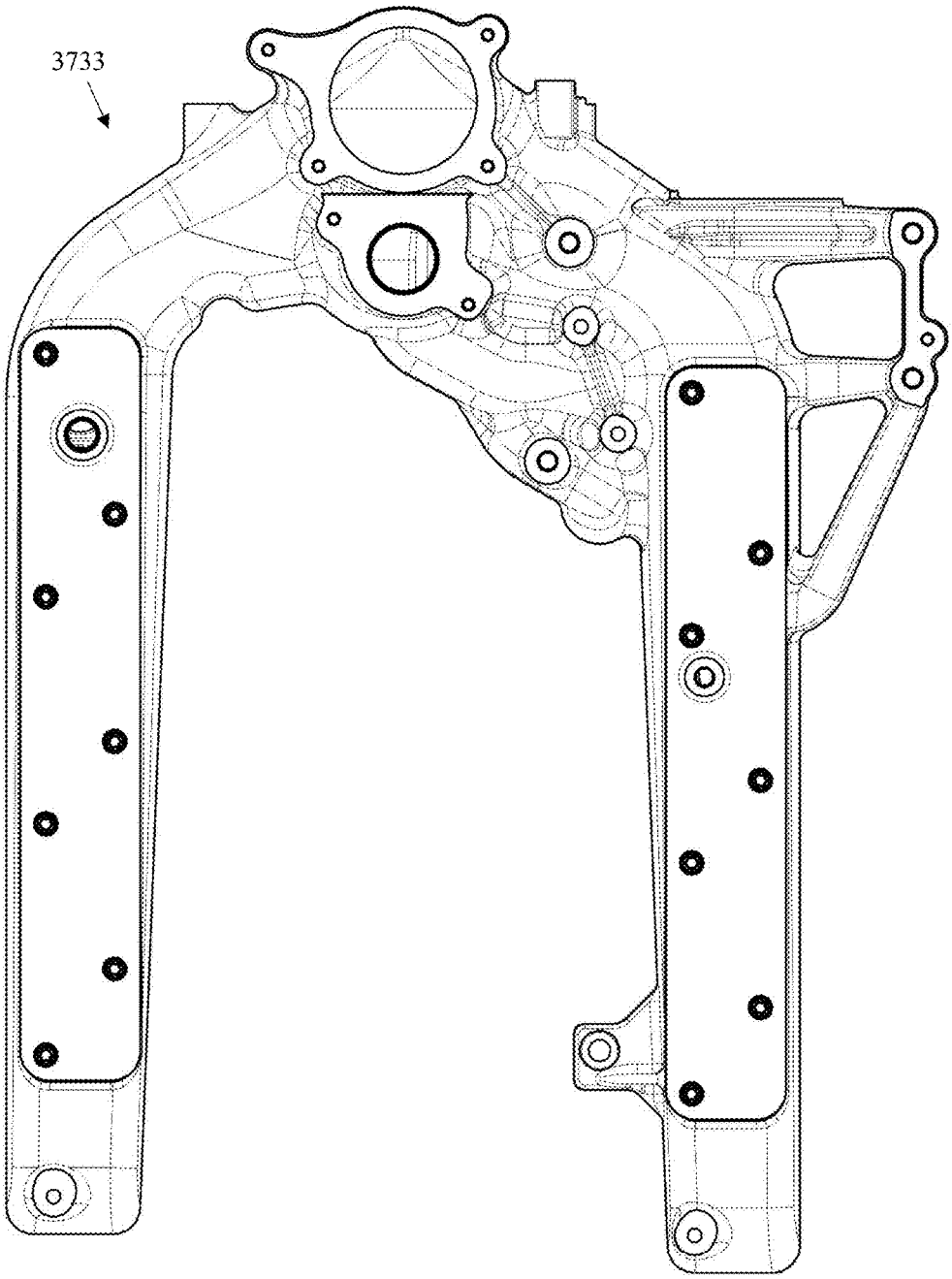
FIG. 37 illustrates the front plan view of an alternative embodiment of the hollow intake manifold of FIG. 28, with plated tops and with EGR components, according to an aspect.

FIG. 37 illustrates the front plan view of an alternative embodiment of the hollow intake manifold 3733 of FIG. 28, with plated tops and with EGR components, according to an aspect.

Figure 38:
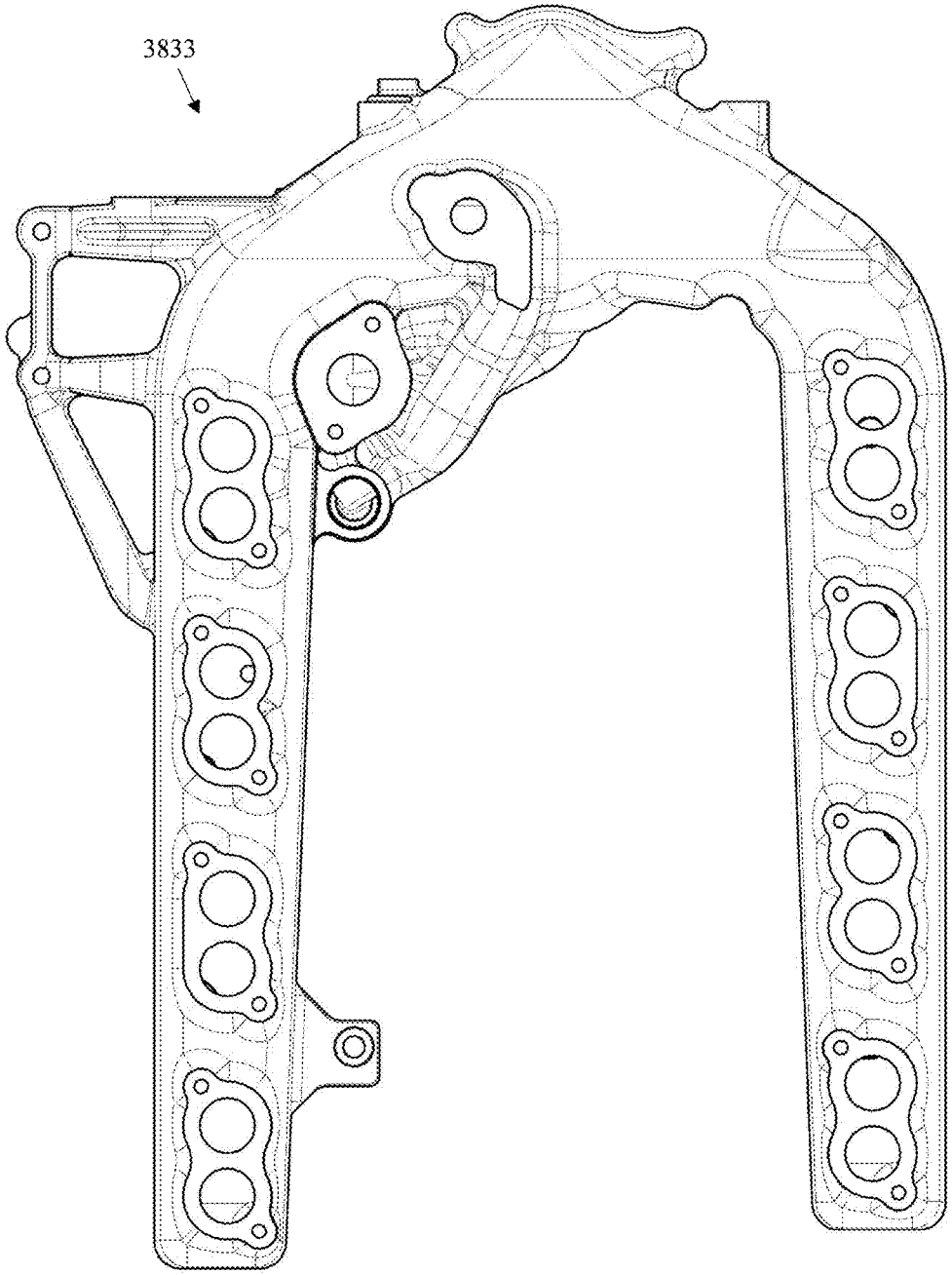
FIG. 38 illustrates the back plan view of the hollow intake manifold of FIG. 37, according to an aspect.

FIG. 38 illustrates the back plan view of the hollow intake manifold 3833 of FIG. 37, according to an aspect.

Figure 39:
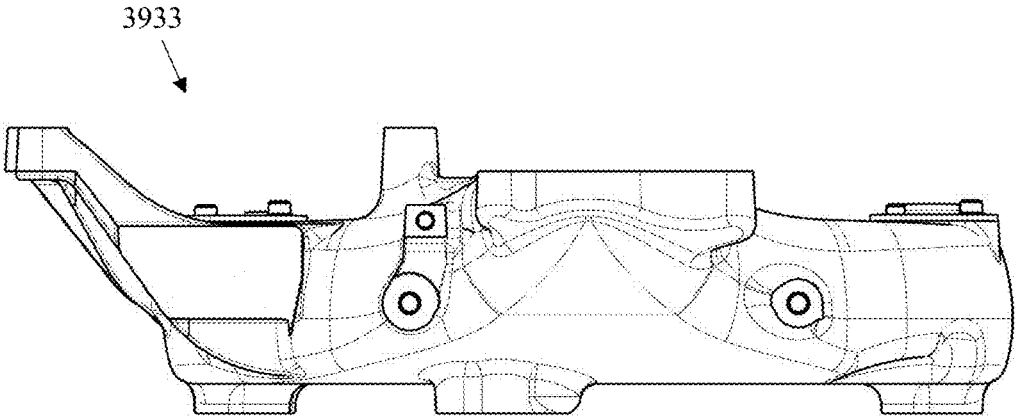
FIG. 39 illustrates the top elevation view of the hollow intake manifold of FIG. 37, according to an aspect.

FIG. 39 illustrates the top elevation view of the hollow intake manifold 3933 of FIG. 37, according to an aspect.

Figure 40:
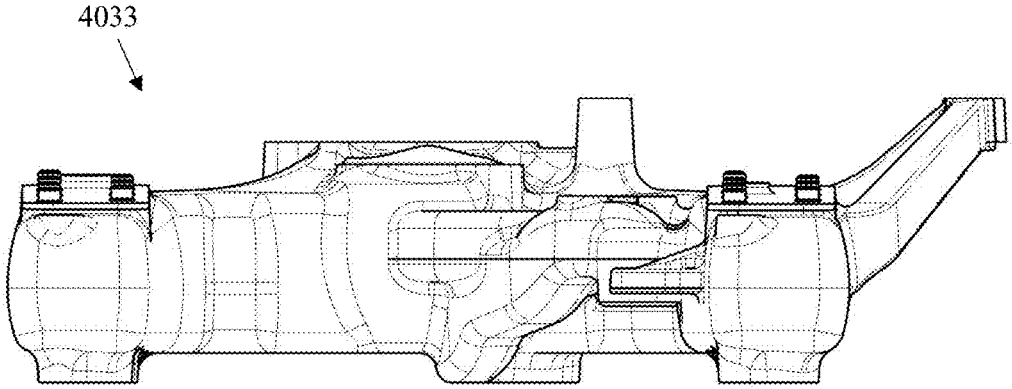
FIG. 40 illustrates the bottom elevation view of the hollow intake manifold of FIG. 37, according to an aspect.

FIG. 40 illustrates the bottom elevation view of the hollow intake manifold 4033 of FIG. 37, according to an aspect.

Figure 41:
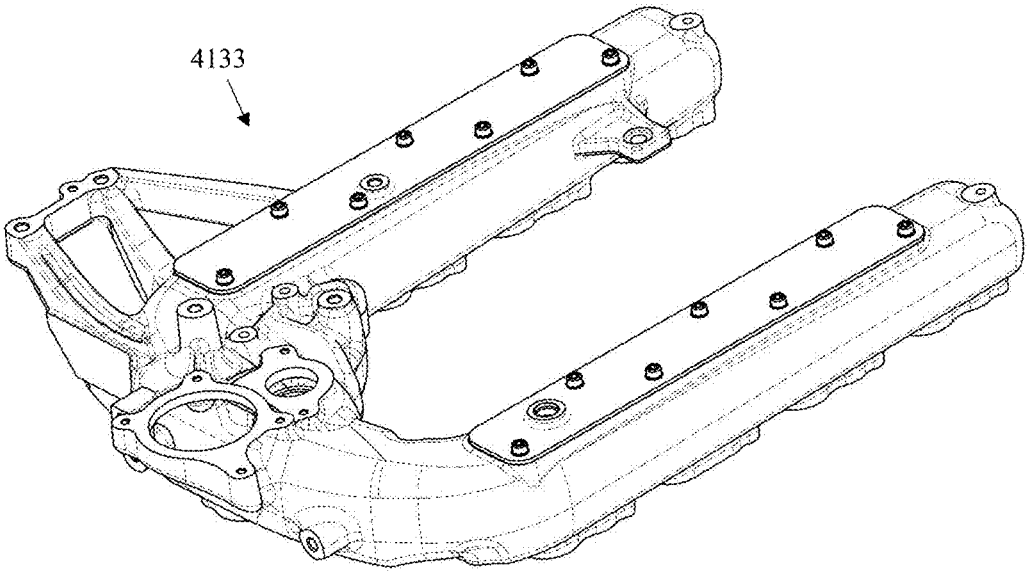
FIG. 41 illustrates the front left perspective view of the hollow intake manifold of FIG. 37, according to an aspect.

FIG. 41 illustrates the front left perspective view of the hollow intake manifold 4133 of FIG. 37, according to an aspect.

Figure 42:
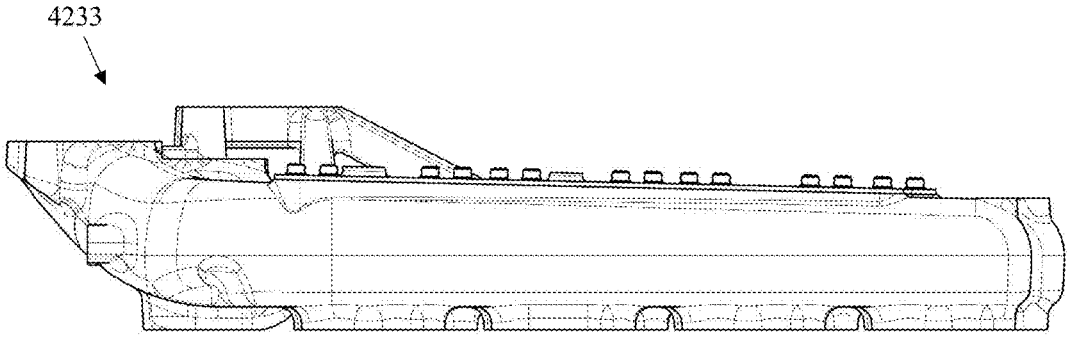
FIG. 42 illustrates the left side elevation view of the hollow intake manifold of FIG. 37, according to an aspect.

FIG. 42 illustrates the left side elevation view of the hollow intake manifold 4233 of FIG. 37, according to an aspect.

Figure 43:
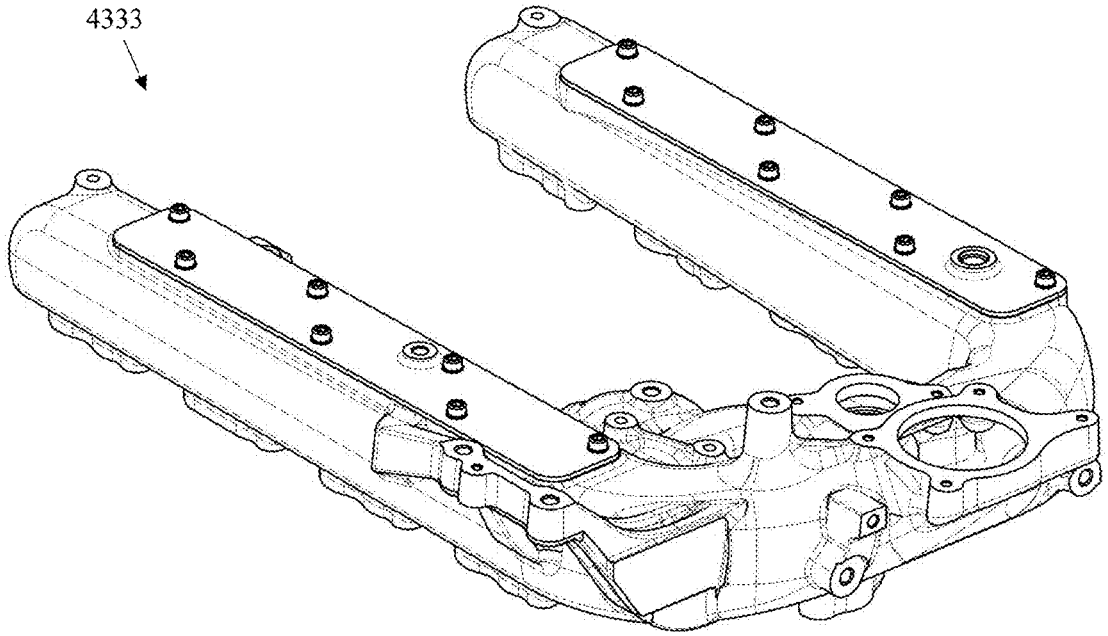
FIG. 43 illustrates the front right perspective view of the hollow intake manifold of FIG. 37, according to an aspect.

FIG. 43 illustrates the front right perspective view of the hollow intake manifold 4333 of FIG. 37, according to an aspect.

Figure 44:
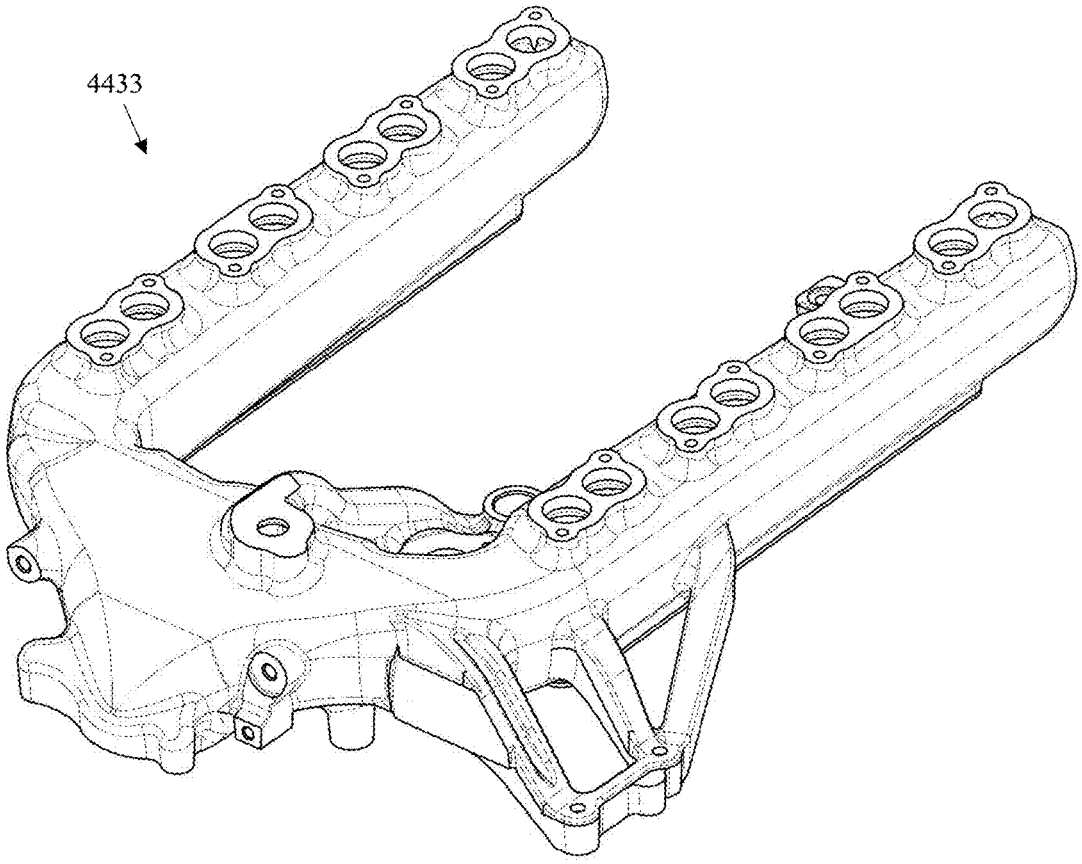
FIG. 44 illustrates the back right perspective view of the hollow intake manifold of FIG. 37, according to an aspect.

FIG. 44 illustrates the back right perspective view of the hollow intake manifold 4433 of FIG. 37, according to an aspect.

Figure 45:
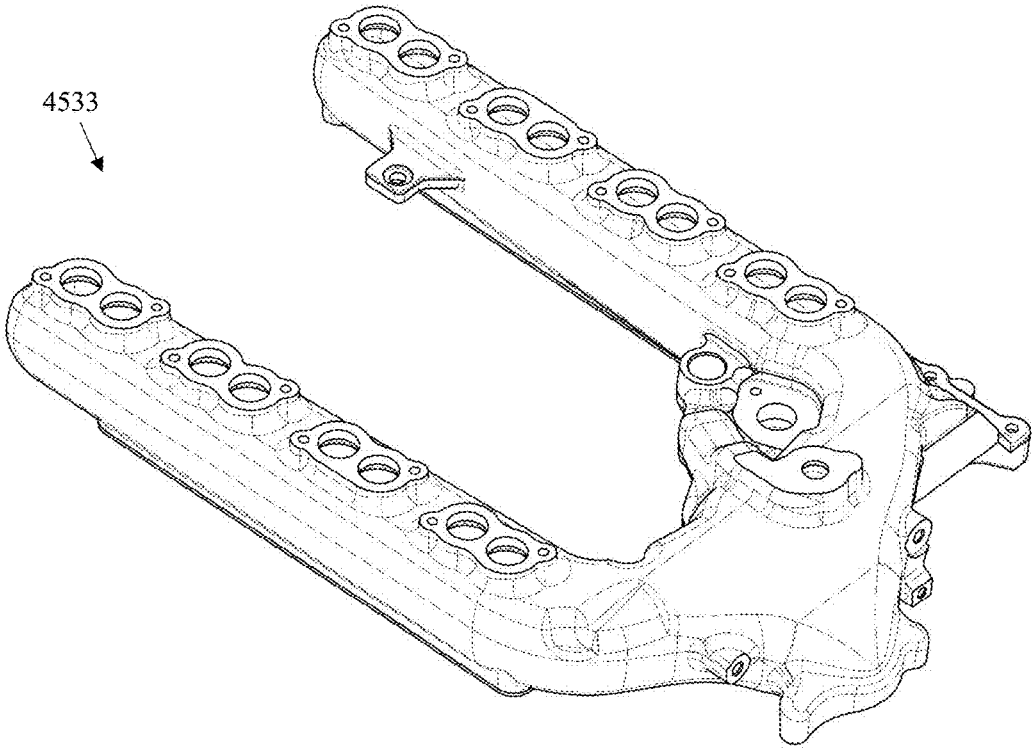
FIG. 45 illustrates the back left perspective view of the hollow intake manifold of FIG. 37, according to an aspect.

FIG. 45 illustrates the back left perspective view of the hollow intake manifold 4533 of FIG. 37, according to an aspect.

It should be understood that an intake manifold of any design for any make or model of vehicle having an internal combustion engine may be suitably provided with a hollow interior, for improved engine performance.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. An intake manifold for an internal combustion engine comprising: at least one runner having a top end, a bottom end, a front side, and a back side defining a hollow interior space wherein the at least one runner has a continuously tapered shape in a first direction caused by the top end having a first height greater than a second height of the bottom end, the intake manifold further comprising a port for receiving air into the hollow interior space, the back side having a plurality of circular cylinder holes having continuously rounded sloping edges on an interior side within the hollow interior space, the plurality of circular cylinder holes leading to and aligning with cylinder head openings of the internal combustion engine and a plurality of bolt holes configured for receiving a plurality of bolts, each bolt having a bolt head and a bolt thread, the front side having a plurality of access holes aligning with the plurality of bolt holes, the access holes being configured to allow a user to access and secure the bolt head using a bolt-securing tool, the access holes being further configured to receive a seal, such that the intake manifold can be secured to the internal combustion engine with no portion of the bolt thread lying within the hollow interior space of the intake manifold thus preventing obstruction of air circulation through the hollow interior space.

2. The intake manifold of claim 1, wherein the first height is greater than the second height by nine-sixteenths of an inch, and wherein the at least one runner has a first width at the top end and a second width at the bottom end, and wherein the continuously tapered shape is further caused in a second direction by the first width being greater than the second width.

3. The intake manifold of claim 1, wherein the intake manifold can be secured to the internal combustion engine with no portion of the bolt head lying within the hollow interior space of the intake manifold.

4. The intake manifold of claim 1, comprising a left runner and a right runner, wherein the port for receiving air communicates with the hollow interior space of the left runner and the right runner.

5. The intake manifold of claim 1, wherein the access holes further comprise threading.

6. The intake manifold of claim 5, wherein the seal is an O-ring boss seal.

7. The intake manifold of claim 1, having no components for exhaust gas recirculation.

8. The intake manifold of claim 1, further comprising at least one removable top cover configured for sealing the plurality of access holes and fitting onto a main body of the intake manifold, the removable top cover having the plurality of bolt holes for securing the removable top cover to the main body.

9. An intake manifold for an internal combustion engine comprising: at least one runner having a top end, a bottom end, a front side and a back side defining an interior space wherein the at least one runner has a continuously tapered shape in a first direction caused by the top end having a first height greater than a second height of the bottom end, the interior space having a hollow interior portion and an interior exhaust gas recirculation portion housing exhaust gas recirculation components, and a port for receiving air into the hollow interior portion, the back side having a plurality of cylinder holes aligning with cylinder head openings of the internal combustion engine and a plurality of bolt holes configured for receiving a plurality of bolts, each bolt having a bolt head and a bolt thread, the front side having a plurality of access holes aligning with the plurality of bolt holes, the access holes being configured to allow a user to access and secure the bolt head using a bolt-securing tool, the access holes being further configured to receive a seal, such that the intake manifold can be secured to the internal combustion engine with no portion of the bolt thread lying within the hollow interior portion of the intake manifold thus preventing obstruction of air circulation through the hollow interior portion.

10. The intake manifold of claim 9, wherein the first height is greater than the second height by at least nine-sixteenths of an inch.

11. The intake manifold of claim 9, wherein the intake manifold can be secured to the internal combustion engine with no portion of the bolt head lying within the hollow interior portion of the intake manifold.

12. The intake manifold of claim 9, comprising a left runner and a right runner, wherein the port for receiving air communicates with the hollow interior portion of the left runner and the right runner.

13. The intake manifold of claim 9, wherein the access holes further comprise threading.

14. An intake manifold for an internal combustion engine comprising: at least one runner having a top end, a bottom end, a front side, and a back side defining a hollow interior space having a smooth surface between a first cylinder hole of a plurality of cylinder holes and a last cylinder hole of the plurality of cylinder holes, the smooth surface comprising a bottom surface, an opposite top surface, a left surface, an opposite right surface, wherein no protrusions extend from the bottom surface, the top surface, the left surface, or the right surface; and wherein the at least one runner has a continuously tapered shape in a first direction caused by the top end having a first height greater than a second height of the bottom end, the intake manifold further comprising a port for receiving air into the hollow interior space, the back side having the plurality of cylinder aligning with cylinder head openings of the internal combustion engine, wherein the plurality of cylinder holes extends though a length of the at least one runner such that the first cylinder hole of the plurality of cylinder holes is at the top end, and the last cylinder hole of the plurality of cylinder holes is at the bottom end, and wherein the smooth surface creates a smooth airflow channel with no obstructions impeding the airflow, such that the first cylinder hole receives a first volume of air and the last cylinder hole receives a last volume of air wherein the last volume of air is 2 percent less than the first volume of air; the intake manifold further comprising a plurality of bolt holes configured for receiving a plurality of bolts, each bolt having a bolt head and a bolt thread, the front side having a plurality of access holes aligning with the plurality of bolt holes, the access holes being configured to allow a user to access and secure the bolt head using a bolt-securing tool, the access holes being further configured to receive a seal, such that the intake manifold can be secured to the internal combustion engine with no portion of the bolt thread lying within the hollow interior space of the intake manifold thus preventing obstruction of air circulation through the hollow interior space.

15. The intake manifold of claim 14, wherein the first height is greater than the second height by at least nine-sixteenths of an inch.

16. The intake manifold of claim 14, wherein the intake manifold can be secured to the internal combustion engine with no portion of the bolt head lying within the hollow interior space of the intake manifold.

17. The intake manifold of claim 14, comprising a left runner and a right runner, wherein the port for receiving air communicates with the hollow interior portion of the left runner and the right runner.

18. The intake manifold of claim 14, wherein the access holes further comprise threading.

19. The intake manifold of claim 18, wherein the seal is an O-ring boss seal.

* * * * *